US005562152A

United States Patent [19]

Gerber et al.

[11] Patent Number: 5,562,152

[45] **Date of Patent: * Oct. 8, 1996**

[54] STRIP CASTING APPARATUS WITH ELECTROMAGNETIC CONFINING DAM

[75] Inventors: Howard L. Gerber, Chicago, Ill.; Ismael G. Saucedo, Valparaiso, Ind.

[73] Assignee: Inland Steel Company, Chicago, Ill.

[ * ] Notice: The portion of the term of this patent subsequent to Jun. 22, 2014, has been disclaimed.

[21] Appl. No.: 513,076

[22] Filed: Aug. 9, 1995

Related U.S. Application Data

[62] Division of Ser. No. 263,874, Jun. 22, 1994, Pat. No. 5,487,421.

[51] Int. Cl.[6] ..... B22D 11/06; B22D 27/02

[52] U.S. Cl. ..... 164/503; 164/428

[58] Field of Search ..... 164/467, 428, 164/480, 503

[56] References Cited

U.S. PATENT DOCUMENTS

| | | | |
|---|---|---|---|
| 4,020,890 | 5/1977 | Olsson | 164/49 |
| 4,762,653 | 8/1988 | Senillou et al. | 264/22 |
| 4,936,374 | 6/1990 | Praeg | 164/503 |
| 4,974,661 | 12/1990 | Lari et al. | 164/503 |
| 4,986,339 | 1/1991 | Miyazawa | 164/466 |
| 5,197,534 | 3/1993 | Gerber et al. | 164/467 |
| 5,251,685 | 10/1993 | Praeg | 164/467 |
| 5,279,350 | 1/1994 | Gerber | 164/467 |

FOREIGN PATENT DOCUMENTS

| | | | |
|---|---|---|---|
| 60-106651 | 6/1985 | Japan | B22D 11/10 |
| 62-104653 | 5/1987 | Japan | B22D 11/06 |

*Primary Examiner*—Kuang Y. Lin

*Attorney, Agent, or Firm*—Marshall, O'Toole, Gerstein, Murray & Borun

[57] ABSTRACT

A strip casting apparatus comprises a pair of counter-rotating casting rolls having a vertically extending, arcuately tapering gap therebetween for containing a pool of molten metal. The gap has an open end near which is an electromagnetic dam for preventing the escape of molten metal through that open end. Various expedients are provided for improving the operation and efficiency of the dam. In one embodiment, projections of magnetic material extend from the dam in mutually overlapping relation with peripheral lips on the casting rolls. In another embodiment, the dam has a confining coil with a front surface (a) facing the open end of the gap and (b) having an arcuately tapering contour conforming to the contour of the gap. The electric current flowing through (i) the wide upper part of the confining coil's tapered front surface, facing the wide upper part of the molten metal pool, is greater than the current flowing through (ii) the narrow lowermost part of the confining coil's front surface, facing the narrow lower part of the molten metal pool.

29 Claims, 16 Drawing Sheets

STRIP CASTING APPARATUS WITH ELECTROMAGNETIC CONFINING DAM

This is a division of U.S. application Ser. No. 08/263,874, filed Jun.22, 1994, now Pat. No. 5,487,421.

The present invention relates generally to electromagnetic confining dams and more particularly to an electromagnetic confining dam for use with a strip casting apparatus.

A strip casting apparatus is employed to continuously cast molten metal into a solid strip, e.g. steel strip. A strip casting apparatus typically comprises a pair of horizontally spaced, counter-rotating rolls having a vertically extending gap therebetween for receiving and containing a pool of molten metal. The gap defined by the rolls tapers arcuately in a downward direction toward the nip between the rolls. The rolls are cooled and in turn cool the molten metal as the molten metal descends through the gap, exiting as a solid metal strip below the nip between the rolls.

The gap has an open end adjacent each end of a roll. The molten metal is unconfined by the rolls at each open end of the gap. To prevent molten metal from escaping outwardly through the open end of the gap, electromagnetic dams have been employed. One type of electromagnetic dam utilizes a magnetic core encircled by an electrically conductive coil and having a pair of spaced magnet poles located adjacent the open end of the gap. The magnet is energized by the flow through the coil of a time-varying current (e.g., alternating current or fluctuating direct current), and the magnet generates a time-varying magnetic field extending across the open end of the gap and between the poles of the magnet. The magnetic field exerts a magnetic confining pressure on the pool of molten metal at the open end of the gap. The magnetic field can be either horizontal or vertical, depending upon the disposition of the poles of the magnet. Examples of magnets which produce a horizontal field are described in Pareg [sic] U.S. Pat. No. 4,936,374 and in Praeg U.S. Pat. No. 5,251,685. Examples of magnets which produce a vertical magnetic field are described in Lari, et al. U.S. Pat. No. 4,974,661.

Another expedient for magnetically confining molten metal at the open end of the gap between a pair of strip casting rolls is to locate, adjacent the open end of the gap, a vertically disposed confining coil having a front surface facing the open end of the gap, adjacent thereto. A time-varying electric current is flowed through the confining coil to generate a horizontal magnetic field which extends from the front surface of the confining coil through the open end of the gap and exerts a magnetic confining pressure on the pool of molten metal at the open end of the gap. Enveloping a substantial part of the confining coil, other than the front surface thereof, is a member composed of magnetic material. This magnetic member substantially prevents the time-varying electric current from flowing along surfaces of the confining coil other than its front surface, and also provides a low reluctance return path for the magnetic field. A coil shield composed of non-magnetic, electrically conductive material (e.g. copper) substantially envelopes the magnetic member and confines that part of the magnetic field which is outside of the low reluctance return path to substantially a space adjacent the open end of the gap. Embodiments of a coil-type of magnetic confining dam are described in Gerber, et al. U.S. Pat. No. 5,197,534 and in Gerber U.S. Pat. No. 5,279,350. The disclosures of all the patents identified above are incorporated herein by reference.

The magnetic member employed in the coil-type magnetic confining dam has a pair of terminal ends, one located on each side of the front surface of the vertically disposed confining coil. It is desirable to mechanically or physically shield the terminal ends of the magnetic member from the molten metal at the open end of the gap between the two strip casting rolls. This must be done without adversely affecting the cooling and solidification of the molten metal adjacent the open end of the gap.

The open end of the gap between the two casting rolls, and the molten metal pool at that location, have a width which tapers arcuately in a downward direction. That width is broadest at the top of the molten metal pool and narrowest at the nip between the two rolls. The front surface of the confining coil has a contour which conforms to the contour of the open end of the gap. Accordingly, the front surface of the confining coil is widest at an upper part thereof and narrowest at a lower end which is directly opposite the nip between the rolls.

The magnetic pressure exerted at a given vertical level of the front surface of the magnetic confining coil is dependent upon the magnetic flux density at that location which in turn is dependent upon the current density at that location. The current density at a given location depends upon (1) the width there of the conductor (i.e. the front surface of the confining coil) and (2) the total current flow through the conductor. The wider the conductor, the larger the current flow in order to obtain a given, desired current density. The upper part of the molten metal pool at the open end of the gap is relatively wide, as is that part of the front surface of the confining coil at the same vertical location. Accordingly, at that upper location, in order to provide the desired current density, there must be a relatively large current flowing through the confining coil.

At the substantially lower vertical location corresponding to the nip between the two casting rolls, the molten metal pool at the open end of the gap is relatively narrow. The ferrostatic pressure of the molten metal is at a maximum at the nip. Accordingly, the magnetic pressure and magnetic flux density generated there must also be a maximum. However, the width of the front surface of the confining coil directly opposite the nip is quite narrow. Therefore, the necessary current density required to generate the desired magnetic flux density there can be developed with less current than that required to develop the required current density needed at higher vertical locations where the gap is much wider. In other words, (a) the current required to develop the desired current density and magnetic flux density at the open end of the gap, at locations near the uppermost part of the molten metal pool, is greater than (b) the current required at a location opposite the nip between the casting rolls. A current sufficiently large to produce the desired current density opposite the uppermost part of the molten metal pool, can produce, at the nip between the casting rolls, a current density which is larger than is desirable. As a result, the magnetic flux density and the magnetic pressure at the nip are excessive, and they can cause undesirable turbulence in the molten metal adjacent the nip. In addition, the narrow lowermost part of the confining coil, facing the nip, can become overheated due to the excessive current density there.

The problem described in the preceding paragraph becomes particularly difficult when the depth of the molten metal pool between the two casting rolls is a large fraction (>½) of the radius of a roll. For example, assuming a roll having a radius of 60 cm and a pool depth of 40 cm, the width of the pool at the top thereof is 31 cm. The width of the front surface of the confining coil is typically slightly larger than the width of the pool at the top of the pool. At that width, a current of approximately 20,000 amperes (A) is required to develop a magnetic field sufficient to contain the molten metal at the top of the pool. However, at the nip between the rolls, the width of the pool may be only 0.25–1.0 cm, and the corresponding width of the front surface of the coil, although somewhat larger, is correspondingly narrow (e.g., 2–3 cm). At those narrow widths, 20,000 A is far more than the current necessary to contain 40 cm of pool depth, and such a large current there can cause problems.

Current has typically been supplied to the confining coil of the electromagnetic dam by bus bars connected to a transformer at a location relatively remote from the electromagnetic dam. A single transformer is typically employed. There is a power loss between the transformer and the confining coil, and the power loss is proportional to the square of the current. When a relatively high current is needed to generate the desired magnetic flux density for containing the molten metal at the uppermost part of the pool, the power loss can be substantial when a single transformer is employed.

Transformers, when applied to low inductance loads such as electromagnetic confinement dams, are not ideal devices. They exhibit a defect called leakage inductance which limits the amount of current which can be supplied to the dam for a given input voltage to the transformer. The voltage across the leakage inductance subtracts from the voltage across the load (i.e., the confinement dam) which would have been supplied in the absence of leakage inductance. Leakage inductance results (generally unavoidably) because the magnetic flux, generated by the primary coil of the transformer, is insufficiently coupled to the transformer's secondary coil. Some of the flux leaks away (leakage magnetic flux). Leakage magnetic flux is proportional to input current: the higher the input current, the greater the leakage magnetic flux. The greater the leakage magnetic flux, the greater the voltage across the leakage inductance and the lower the voltage across the load. Leakage inductance is therefore a factor involved in determining the amount of voltage required to provide the required current for the confining coil, e.g. 20,000 A. Transformer manufacturers have found it impractical to design a transformer which will provide 20,000 A with a low leakage inductance, when the frequency is 3,000 to 5,000 Hertz ($H_z$), a range of frequencies desirably employed in coil-type confinement dams.

Mutual inductance between transformers, a defect related to leakage inductance, occurs when several independent transformers are employed. Some of the flux from the primary coil of one transformer couples with the primary coil of another transformer creating a mutual inductance. The flux which couples in this manner is lost, for all practical purposes, and increases the difficulty in achieving, in a transformer, a current of high magnitude.

SUMMARY OF THE INVENTION

The present invention is directed to a strip casting apparatus comprising expedients for dealing with the problems which can arise when employing coil-type magnetic confining dams.

In accordance with one embodiment of the present invention, the terminal ends of the dam's magnetic member are mechanically or physically protected from the molten metal at the open end of the gap between the two strip casting rolls, and this is done without adversely affecting the cooling and solidification of the molten metal adjacent the open end of the gap.

This embodiment of the invention comprises a peripheral roll lip at the end of each casting roll. The lip has a terminal end surface facing the front surface of the confining coil, adjacent thereto, and defines part of the flow path followed by the magnetic field. Located alongside the peripheral roll lip in a radially inward direction therefrom, is an element which defines another part of the flow path followed by the magnetic field. In one case, this element can be separate and discrete from the magnetic member employed in the dam; in another case, this element can be a projection which extends from the magnetic member beyond the front surface of the confining coil alongside of and disposed radially inwardly of the peripheral roll lip. In the latter case, the peripheral roll lip is interposed between (a) the magnetic member's projection and (b) the molten metal, and the lip shields the terminal end of the projection from the molten metal. In both cases, the magnetic member and the casting rolls are provided with components which (i) define the flow path followed by the magnetic field adjacent the open end of the gap and (ii) protect the terminal ends of the magnetic member from the molten metal.

In another embodiment in accordance with the present invention, the front surface of the confining coil has a top part located opposite the uppermost part of the molten metal pool (where the current requirement is the highest); and this top part of the coil's front surface is provided with a current substantially greater than the current provided to the front surface of the confining coil at a location opposite the nip between the casting rolls, where the current requirement is not so high. At each location opposite the pool there is sufficient current to produce the current density required to confine the molten metal at that location. However, the magnetic flux density and the magnetic pressure at the nip are not so high as to cause undesirable turbulence in the molten metal adjacent the nip. Moreover, in this embodiment, both power loss and leakage inductance are reduced.

The advantages described in the preceding paragraph are obtained by employing a confining coil comprising three separate portions: a first vertically disposed, relatively narrow, central conductor portion having a pair of opposite sides, and a pair of wedge-shaped, vertically disposed conductor portions each located on a respective opposite side of the central conductor portion, in close, substantially abutting relation thereto. Each of the wedge-shaped conductor portions is electrically insulated from the central conductor portion. The central conductor portion has a relatively narrow front surface facing the open end of the gap between the two casting rolls. Each of the wedge-shaped conductor portions has a front surface tapering in width from a relatively wide upper part to a relatively narrow lowermost part. Each front surface of each wedge-shaped portion faces the open end of the gap between the two casting rolls. Circuitry is provided for flowing, through the central conductor portion, a first time-varying current having a pre-selected amperage. Circuitry is also provided for flowing through each of the wedge-shaped conductor portions, respective second and third time-varying currents separate and distinct from the first time-varying current. Each of the second and third time-varying currents has a respective pre-selected amperage which can be different than, and typically less than, the pre-selected amperage of the first time-varying current which flows through the central conductor portion.

The central conductor portion has a lowermost part which faces the open end of the gap at the nip between the two casting rolls. Each wedge-shaped conductor portion has a lowermost part which terminates above the lowermost part of the central conductor portion. The current density in that part of the confining coil located opposite the top of the molten metal pool, where the pool is the widest, is determined by the current flowing through all three portions of the confining coil. The current density in that part of the confining coil located opposite the nip between the two casting rolls, where the width of the molten metal pool is narrowest, is determined by only that current flowing through the central conductor portion of the confining coil. The current flowing through the lowermost parts of the two wedge-shaped conductor portions do not contribute to the current density in that part of the confining coil opposite the nip between the two casting rolls. This is because the lowermost part of each wedge-shaped conductor portion is disposed above the lowermost part of the central conductor portion, and the current flowing through each of these wedge-shaped conductor portions does not descend downwardly as far as a location opposite the nip between the two casting rolls.

For example, assuming that the current density needed to confine the molten metal pool at the top of the pool requires a total current flow of 20,000 A in that part of the confining coil opposite the top of the molten metal pool; that total current flow typically would be divided among the three conductor portions of the confining coil as follows: 10,000 A in the central conductor portion and 5,000 A in each of the two wedge-shaped conductor portions. In contrast, the current density employed to contain the molten metal pool at the nip between the two casting rolls would be only the 10,000 A flowing through the central conductor portion of the confining coil. There would be no flow of 20,000 A through any single circuit. The maximum current flowing through any single circuit facing the molten metal pool would be only 10,000 A. Because power loss is proportional to the square of the current, the total power loss which would occur when employing a confining coil comprising three separate conductor portions would be the sum of the three power losses resulting form the flow of 10,000 A, 5,000 A and another 5,000 A. This would be substantially less then the power loss due to the flow of 20,000 A through a single circuit.

Each of the three conductor portions of the confining coil is coupled to a primary transformer coil separate and distinct from the primary transformer coil to which the other portions of the confining coil are coupled. The current flowing through each of the respective primary transformer coils is substantially less than the current which would be flowing through a primary transformer coil if the confining coil were one-piece and were coupled to a single transformer. In the case of a single transformer, the input current to the transformer primary coil would be relatively high (e.g. that necessary to produce a current in the secondary coil of 20,000 A). As noted above, a relatively high input current produces a relatively high voltage across a relatively high leakage inductance which in turn results in a relatively low voltage across the load (i.e. the confining coil).

The total leakage inductance (and other inductance losses) in a three-piece confinement coil constructed in accordance with the present invention are less than leakage inductance (and other inductance losses) when using a one-piece confinement coil coupled to a single transformer.

There is, of course, mutual inductance among the three transformers employed in accordance with the present invention; however, because of the lower currents employed and for other reasons, the total inductance loss (mutual inductance plus leakage inductance) when employing three separate transformers in accordance with the present invention, is less than the inductance loss which would occur when employing a single transformer and the relatively high current needed to produce the current density necessary to confine the molten metal pool at the top of the pool.

Other features and advantages are inherent in the subject matter claimed and disclosed or will become apparent to those skilled in the art from the following detailed description in conjunction with the accompanying diagrammatic drawings.

DETAILED DESCRIPTION

Figure 1:
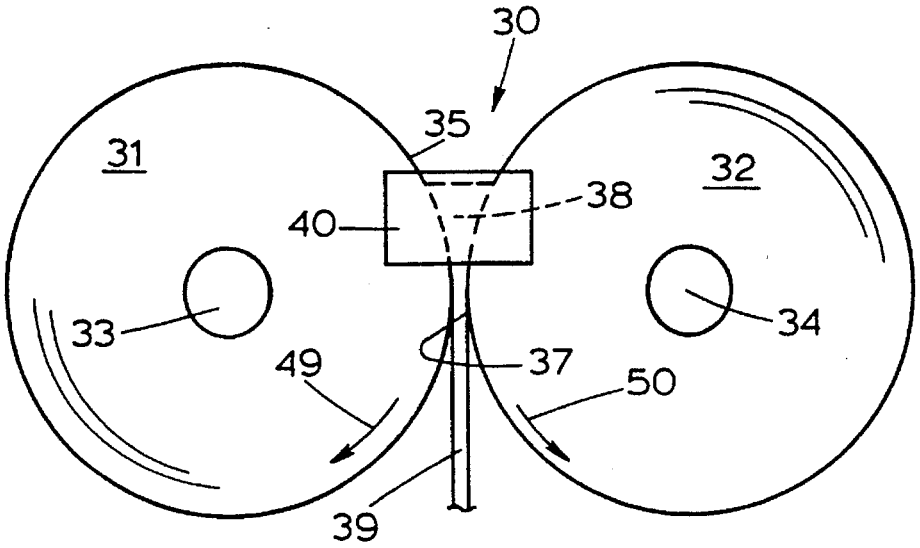
FIG. 1 is an end view of a strip casting apparatus employing an electromagnetic confining dam.
Figure 1A:
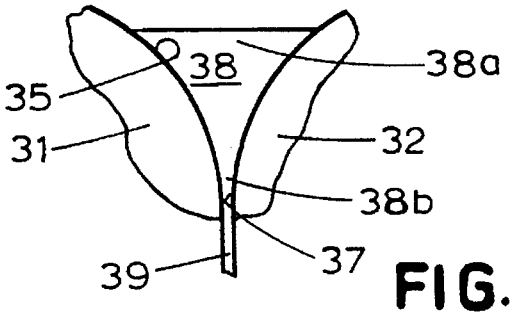
FIG. 1A is an enlarged, fragmentary end view of a portion of the subject matter shown in FIG. 1.
Figure 2:
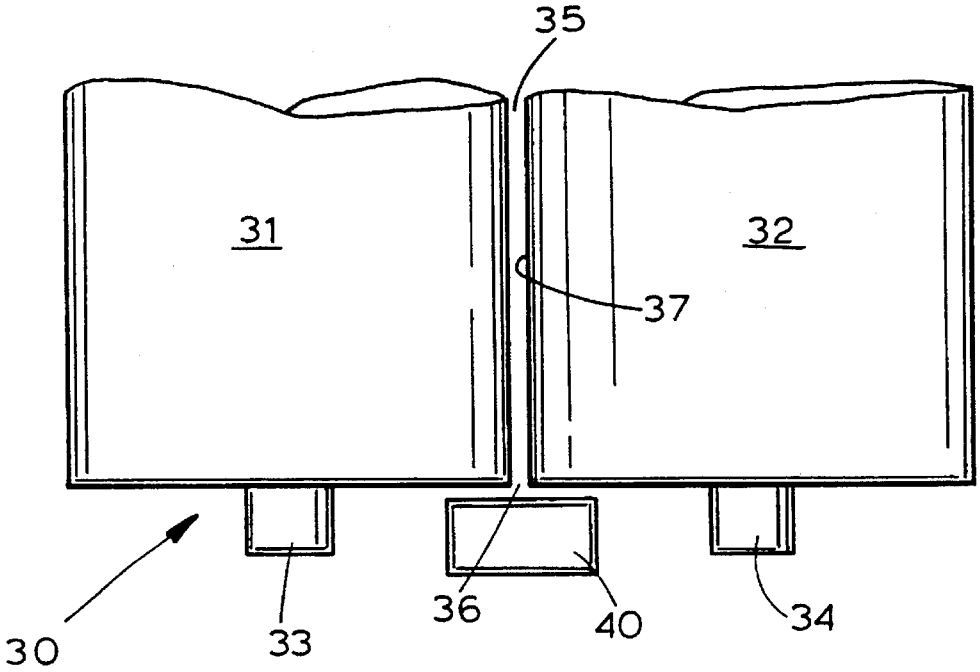
FIG. 2 is a fragmentary plan view of the apparatus.

Referring initially to FIGS. 1, 1A and 2, indicated generally at 30 is a strip casting apparatus comprising a pair of horizontally spaced counter-rotating casting rolls 31, 32 having respective roll axes 33, 34. Rolls 31, 32 have a vertically extending gap 35 between the rolls for containing a pool 38 of molten metal typically composed of steel. Each of casting rolls 31, 32 has the same radius, and molten metal pool 38 has a predetermined maximum height (depth) which is typically a large fraction (e.g. >½) of the radius of rolls 31, 32. Rolls 31, 32 rotate respectively in the direction of arrows 49, 50 shown in FIG. 1. Casting rolls 31, 32 are cooled in a conventional manner (not shown) and in turn cool the molten metal which is solidified as it passes through the nip 37 between rolls 31, 32, exiting from nip 37 as a solid metal strip 39 typically composed of steel.

Gap 35 has an open end 36 (FIG. 2), and located adjacent open end 36 is an electromagnetic dam 40 for preventing the escape of molten metal from pool 38 through open end 36 of gap 35.

Figure 3:
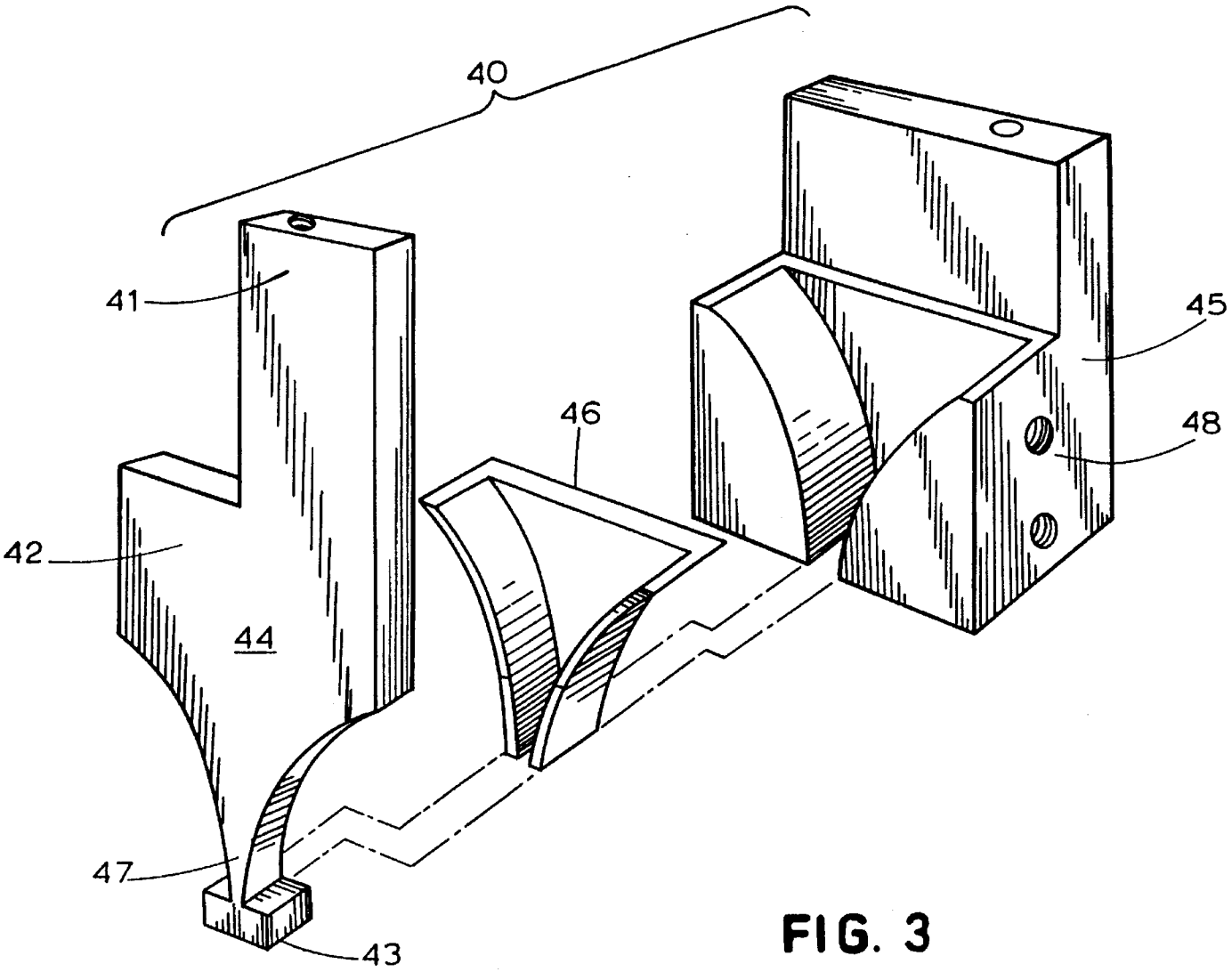
FIG. 3 is an exploded perspective of an electromagnetic confining dam which may be employed in accordance with one embodiment of the present invention.
Figure 4:
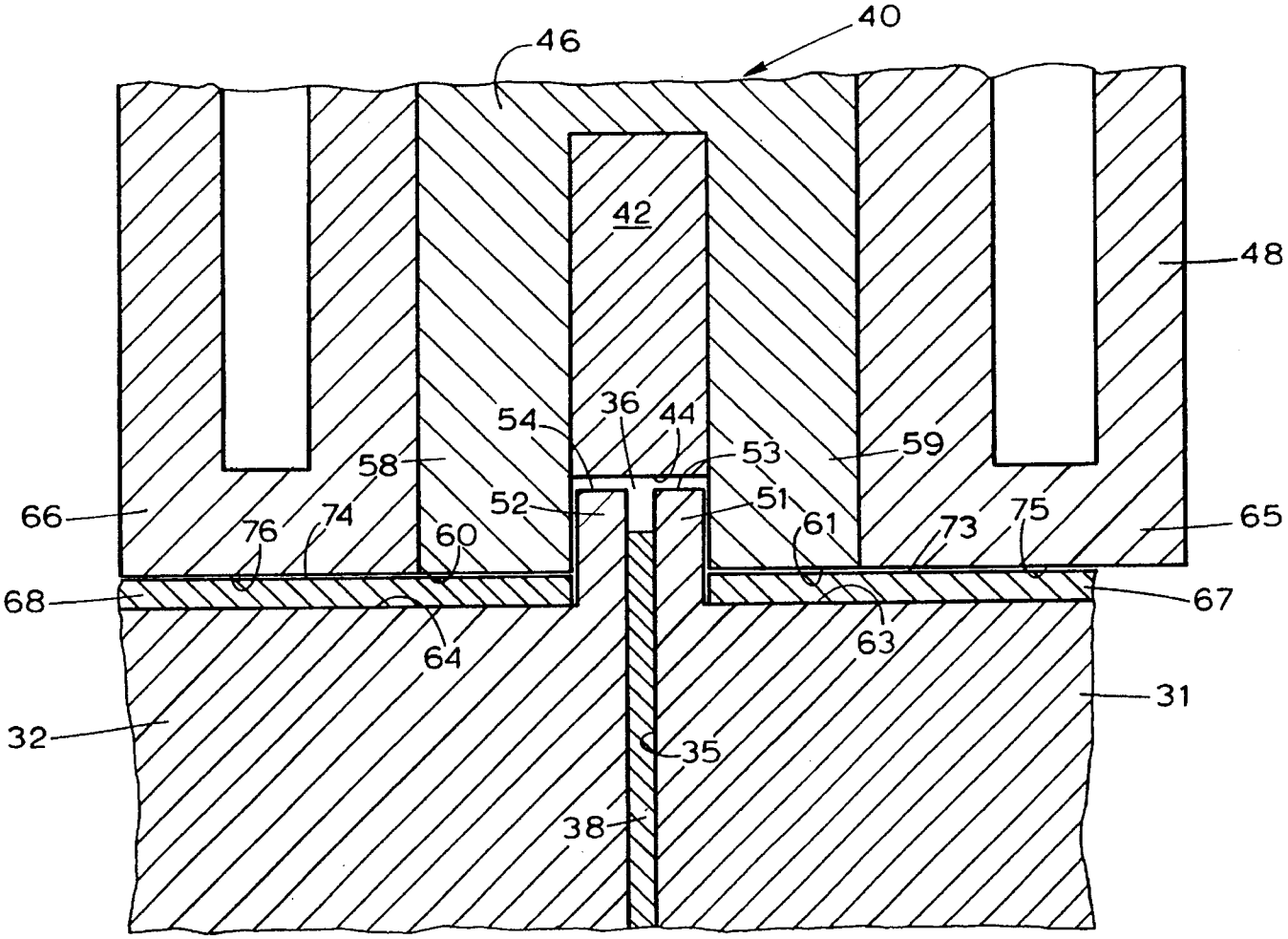
FIG. 4 is a fragmentary, horizontal sectional view illustrating an embodiment of the present invention employing peripheral lips on each of the two casting rolls used in the strip casting apparatus.

One embodiment of dam 40 is illustrated in FIGS. 3–4. Dam 40 comprises a vertically disposed confining coil including a first coil portion 42 having a front surface 44 facing open end 36 of gap 35, adjacent open end 36 (FIG. 4). Coil front surface 44 tapers arcuately downwardly, in a configuration corresponding to the arcuately tapering configuration of gap open end 36. Coil first portion 42 terminates at a lower coil connector portion 43 which electrically connects first coil portion 42 to a second coil portion 45. The entire confining coil is composed of a non-magnetic, electrically conductive material, such as copper.

Enveloping the lower part of coil portion 42, except for front surface 44, is a magnetic member 46 composed of conventional magnetic material. Magnetic member 46 comprises structure for substantially preventing a time-varying electric current from flowing through first coil portion 42 along surfaces of coil portion 42 other than front surface 44, at vertical levels on coil portion 42 enveloped by magnetic member 46. Magnetic member 46 also provides a low reluctance return path for the magnetic field generated by the confining coil. More particularly, referring to FIG. 5, the flowing of a time-varying electric current through the confining coil generates a horizontal magnetic field depicted by lines 56 in FIG. 5. This magnetic field extends from front coil surface 44 through open end 36 of gap 35 and exerts a magnetic confining pressure on molten metal pool 38 at open end 36 of gap 35.

In addition to coil 41–45, dam 40 includes a coil shield 48 (FIGS. 3–4) composed of non-magnetic, electrically conductive material (e.g. copper). Coil shield 48 substantially envelopes magnetic member 46 and comprises structure for confining that part of the magnetic field which is outside of the low reluctance return path defined by magnetic member 46, to substantially a space adjacent open end 36 of gap 35.

In operation, time-varying electric current is introduced into the top part 41 of first coil portion 42, via a bus bar (not shown), then flows downwardly along front surface 44 to lower connector portion 43 then through connection portion 43 to second coil portion 45 through which the current flows upwardly to a bus bar (not shown) which electrically connects coil portion 45 to a current source (e.g. a transformer, not shown in FIG. 3).

Thin films (not shown) of electrical insulation are employed to insulate magnetic member 46 from coil portion 42 and to insulate coil shield 48 from magnetic member 46. Coil parts 41–43 and 45 and coil shield 48 are provided with cooling channels (mostly not shown) through which a cooling fluid is circulated, a conventional expedient within the skill of the art.

The electromagnetic dam illustrated in FIG. 3, and its operation, are described in more detail in the aforementioned Gerber, et al. U.S. Pat. No. 5,197,534, previously incorporated herein by reference.

Referring now to FIGS. 4–7, at each end of each casting roll 31, 32 is a respective peripheral roll lip 51, 52 having a respective terminal end surface 53, 54 facing front surface 44 of the confining coil, adjacent thereto. The magnetic field generated by coil 41–45 is shown by magnetic field lines 56 in FIG. 5. Each peripheral roll lip 51, 52 is composed of a material having a magnetic permeability slightly greater than copper, e.g. a material such as austenitic stainless steel, which is non-magnetic. The electrical conductivity of each roll lip is close to that of the molten steel and less than that of copper. Magnetic member 46, of course, has a magnetic permeability substantially greater than that of copper.

The employment of peripheral roll lips 51, 52 composed of the material described above increases the coupling factor (k) between the confining coil and the molten metal which in turn increases the repulsive magnetic pressure exerted against molten metal pool 38 at open end 36 of gap 35, compared to the same arrangement without such peripheral lips. More particularly, the repulsive magnetic pressure (Pro) can be expressed as follows:

$$P_m = \frac{kB^2}{4\mu_o}$$

where

B is the peak magnetic flux density, and $\mu_o$ is the magnetic permeability of free space.

The coupling factor (k) can be expressed as follows:

$k=1-(\delta/w)$, for $\delta<w$, where $\delta$ is the skin depth of the molten metal, and w is the effective width of the metal pool. Skin depth is the depth to which a magnetic field will penetrate a given material and will be discussed more fully below. A peripheral roll lip composed of the material described above functions to provide a greater effective pool width (w), thereby increasing the coupling factor (k). (The foregoing equation is applicable where the effective pool width (w) is greater than the skin depth ($\delta$), a situation which generally prevails when peripheral roll lips are employed.)

Figure 5:
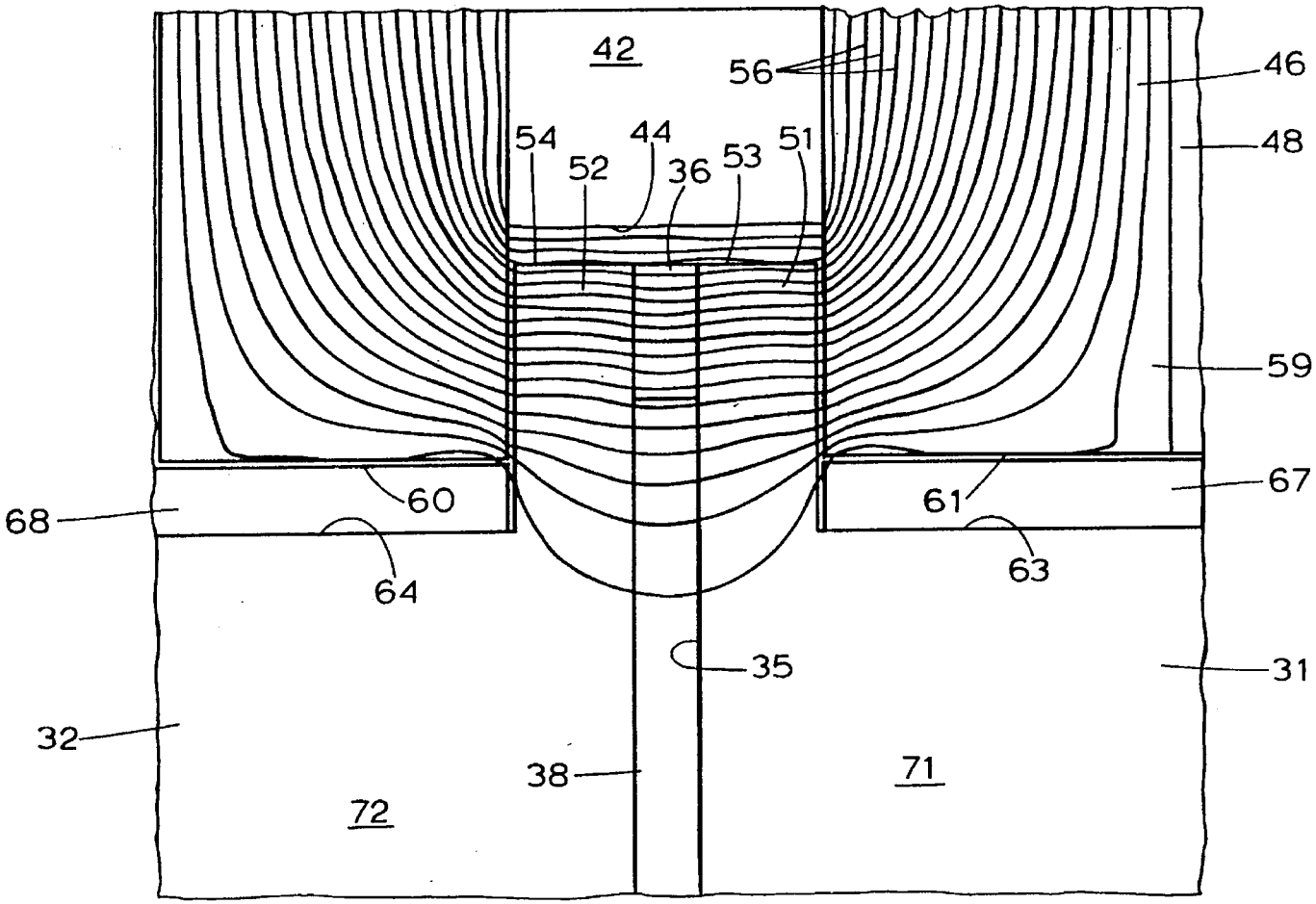
FIG. 5 is a view similar to FIG. 4 (without section lines) showing the magnetic field developed by a strip casting apparatus with an electromagnetic confining dam, all in accordance with the present invention.

Each peripheral roll lip 51, 52 protrudes outwardly from a respective casting roll 31, 32, in an axial direction, toward front surface 44 of the confining coil. In the embodiment of FIGS. 4–5, magnetic member 46 comprises a pair of spaced-apart projections 58, 59 each located on a respective opposite side of front surface 44 of the confining coil and each protruding outwardly beyond front surface 44 toward a respective end 63, 64 of a respective casting roll 31, 32. Each magnetic member projection 58, 59 has a terminal end 60, 61 adjacent an end 64, 63 of a respective casting roll 32, 31. Projections 58–59 are each disposed alongside a respective peripheral roll lip 52, 51, in turn disposed between magnetic member projections 58,59.

Coil shield 48 comprises a pair of spaced-apart projections 65–66 (FIG. 4) each located alongside a respective projection 58, 59 of magnetic member 46 and substantially co-extensive therewith. At the respective end 63, 64 of each casting roll 31, 32 is a roll end shield 68, 67 respectively. Each roll end shield is located radially inwardly of the peripheral roll lip 51, 52 on the corresponding roll 31, 32, and each roll end shield 67, 68 covers the corresponding roll end 63, 64. Roll end shields 67, 68 have a higher electrical conductivity than peripheral roll lips 51, 52 and have the permeability of free space; the roll end shields are typically composed of copper.

Reference is now made to FIG. 5 (in which section lines have been deleted for clarity purposes). Each roll end shield 67, 68 comprises structure (a) for substantially preventing magnetic flux from exiting the adjacent terminal end 60, 61 on projections 58, 59 of magnetic member 46 and (b) for compelling the magnetic field 56 to follow substantially the flow path described in the next sentence. This flow path extends between the magnetic member's projections 58, 59, across peripheral roll lips 52, 51 and across gap 35 adjacent open end 36 thereof. In other words, each peripheral roll lip 51, 52 defines a part of the path followed by magnetic field 56. Similarly, the magnetic member's projections 58, 59 define another part of the path followed by the magnetic field. The apparatus is devoid of any magnetic field shield, between front surface 44 of the confining coil and open end 36 of gap 35, and which is separate and discrete from the confining coil's front surface 44. That surface, being composed of copper, for example, acts as a magnetic field shield and helps confine the magnetic field to the space shown in FIG. 5.

As noted above, peripheral roll lips 51, 52 may be composed of a non-magnetic, electrically conductive material such as austenitic stainless steel. Preferably, the totality of the peripheral surfaces 71, 72 of casting rolls 31, 32 are composed of the same electrically conductive material as peripheral roll lips 51, 52.

That part of a peripheral roll lip 51, 52 which protrudes outwardly beyond the end of a casting roll shield 67, 68 is that part of the peripheral roll lip which is exposed to a substantial extent to the magnetic field; this is the exposed length of the lip. The exposed length of a peripheral roll lip should be greater than about eighty percent of the skin depth ($\delta$) of the molten metal in the pool. If the exposed length of the peripheral lip is substantially less than that described in the preceding sentence, there may be some difficulty in containing molten metal pool 38 behind open end 36 of gap 35. Making the exposed length longer then the value described above will marginally improve containment but at the same time will increase magnetic field losses in the lip, which is undesirable. Strength considerations also determine the maximum length of the lip. The longer the exposed lip length, the greater the mechanical moment creating a stress at the junction between the lip and the main body of the casting roll. Increasing the lip length increases the heat to which a lip is subjected, and that should be avoided. A shorter lip length can be tolerated when one increases the frequency of the time-varying current employed.

With respect to the thickness of the peripheral roll lip, generally, the lower the lip thickness, the better, from a containment standpoint. The minimum lip thickness is generally determined by strength considerations. A lip thickness less than two skin depths of the material of which the lip is composed (e.g. austenitic stainless steel) would be satisfactory for most purposes. Preferably the thickness of the peripheral roll lip should be less than one skin depth (e.g. 0.5–0.8 skin depths).

The skin depth of a material may be expressed by the following formula:

$$\delta = \sqrt{2/\omega\mu\sigma}$$

where $\delta$ is the skin depth of the material in question (e.g. the material of which the peripheral roll lip is composed)

$\omega$ is $2\pi f$ f is the frequency of the time-varying current to be employed $\mu$ is the magnetic permeability of the material $\sigma$ is the electrical conductivity of the material.

Assuming the peripheral roll lip is composed of 304 stainless steel and the frequency employed is 3000 Hz, the skin depth ($\delta$) would be 0.79 cm, and a typical lip thickness could be 0.95 cm ($1.2\delta$).

In the embodiment of FIG. 4, projections 58, 59 on magnetic member 46 are physically separated from molten metal pool 38 by peripheral roll lips 51, 52 as well as being protected by the combination of components which magnetically prevent molten metal pool 38 from flowing outwardly through open end 36 of gap 35.

Figure 7:
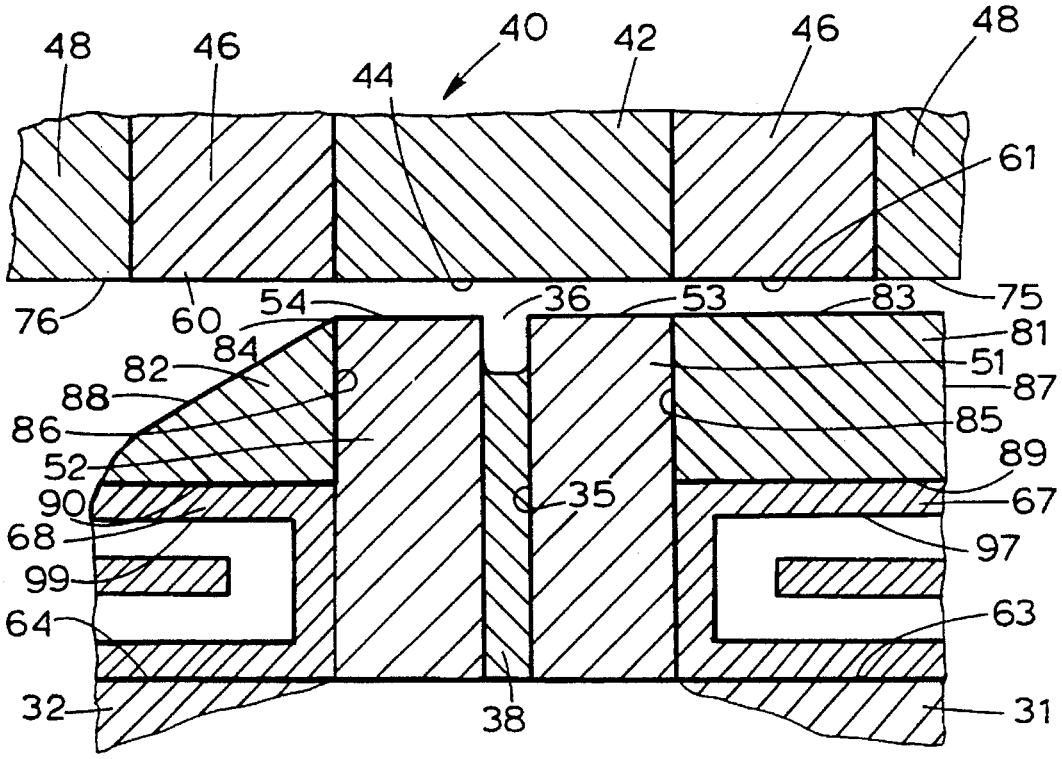
FIG. 7 is an enlarged, fragmentary sectional view similar to FIG. 4 and illustrating a portion of another embodiment of the present invention.

As an alternative to projections 58, 59 on magnetic member 46, one may provide a pair of elements physically unconnected to magnetic member 46. Each such element is composed of a material having an electrical conductivity less than that of copper, each is located alongside a respective peripheral roll lip 51, 52, and each is separate and discrete from magnetic member 46 and spaced therefrom. Two different embodiments of such an element are illustrated in FIG. 7 at 81 and 82, respectively.

Each element 81, 82 comprises the following: a respective front part 83, 84 facing dam 40; a respective first side surface 85, 86 facing, at least to a substantial extent, a respective peripheral roll lip 51, 52; a respective second side surface 87, 88 spaced radially inwardly from first side surface 85, 86; and a respective rear surface 89, 90 adjacent an end 63, 64 of a respective casting roll 31, 32. In the case of second side surface 88 on element 84, that side surface is an extension of front part 84, element 82 having a triangular horizontal cross section. Element 81 has a rectangular horizontal cross section.

Second side surface 88 of triangular element 82 extends angularly in a radially inward direction from that element's front part 84 to its rear surface 90. The distance between side surfaces 86, 88 across element 82, increases from front part 84 to rear surface 90 of element 82, reflecting the triangular cross section of that element.

Each front part 83, 84 of each element 81, 82 faces magnetic member 46 and is substantially co-terminous with a respective terminal end surface 53, 54 of a respective peripheral roll lip 51, 52.

Referring again to magnetic member 46, the embodiment thereof in FIG. 7 differs from the embodiment in FIG. 4 in that the FIG. 4 embodiment has projections 58, 59 which protrude beyond the front surface 44 of confining coil 42; in the embodiment of FIG. 7, there are no projections 58, 59 on magnetic member 46. Instead, in the embodiment of FIG. 7, the magnetic member has a pair of terminal end surfaces 60, 61 which are substantially co-terminus with front surface 44 of the confining coil's first portion 42. In the embodiment of FIG. 7, each terminal end surface 61, 60 on magnetic member 46 faces the front part 83, 84 of a respective element 81, 82.

In a similar manner, coil shield 48 in the embodiment of FIG. 7 differs from coil shield 48 in the embodiment of FIG. 4 in that the FIG. 4 embodiment comprises projections 65, 66 disposed alongside projections 58, 59 of magnetic member 46; in the embodiment of FIG. 7, coil shield 48 has no such projections. Instead, in the embodiment of FIG. 7, coil shield 48 has a pair of terminal end surfaces 75, 76 each of which faces toward an end 63, 64 of a respective casting roll 31, 32; each surface 75, 76 is substantially co-terminous with a respective terminal end surface 61, 60 of magnetic member 46.

As previously noted, each peripheral roll lip 51, 52 may be composed of a non-magnetic material such as austenitic stainless steel; preferably, the entirety of each casting roll is made of austenitic stainless steel. Each of elements 81, 82 may be composed of the same non-magnetic material as lips 51, 52, or, as an alternative, each of elements 81, 82 may be composed of a magnetic materials similar to that employed on magnetic member 46.

Like the embodiment of FIG. 4, the embodiment of FIG. 7 includes a roll end shield 67, 68 at an end 63, 64 of each casting roll 31, 32. Each roll end shield 67, 68 is located radially inwardly of the corresponding peripheral roll lip 51, 52 and axially inwardly of a respective element 81, 82. Each roll end shield 67, 68 is typically composed of copper and has a lower magnetic permeability and a higher electrical conductivity than peripheral roll lips 51, 52 and elements 81, 82. Each roll end shield 67, 68 substantially prevents a magnetic field developed by the confining coil's first portion 42 from following a flow path other than across gap 35 adjacent its open end 36.

Figure 20:
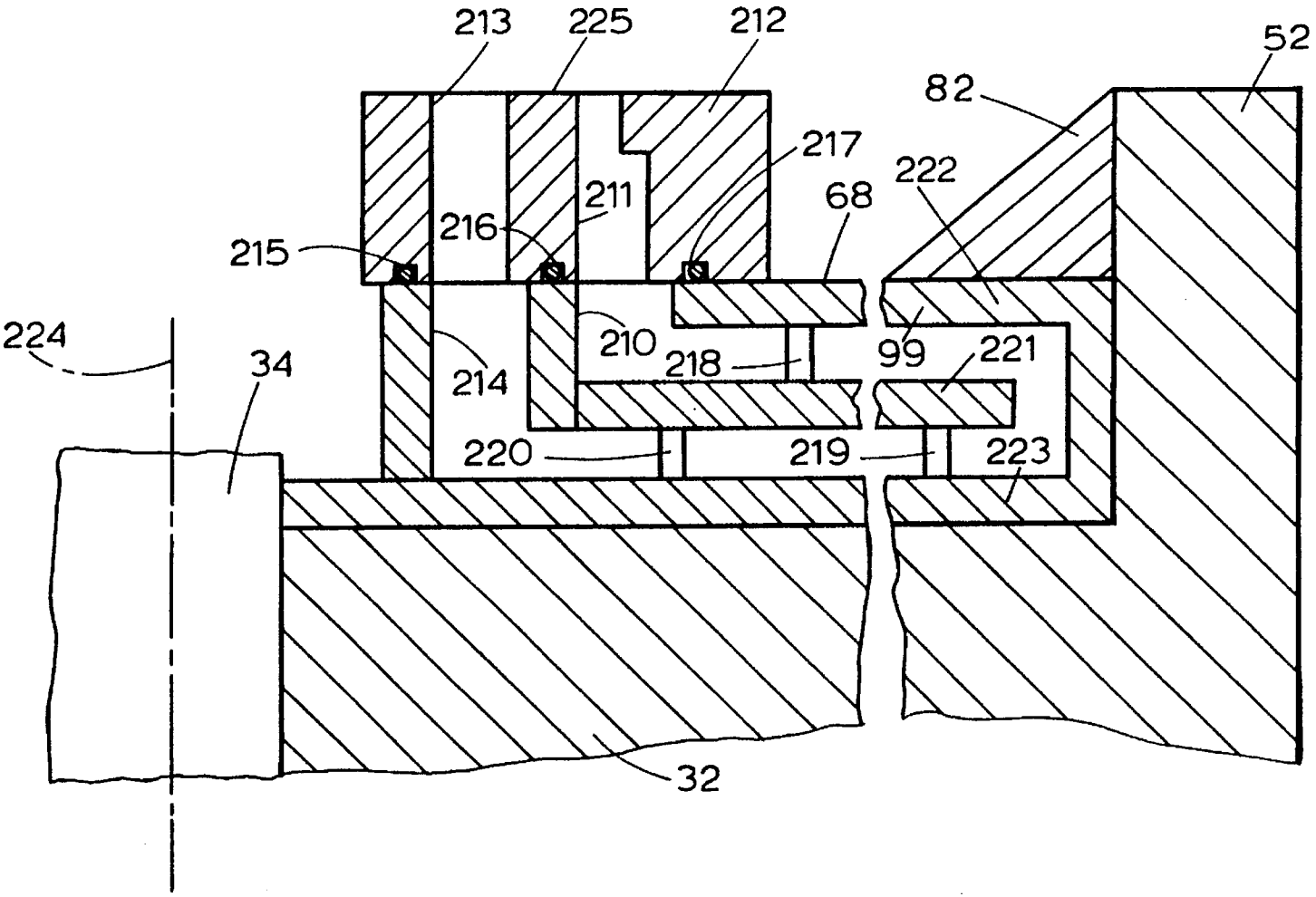
FIG. 20 is an enlarged, fragmentary sectional view showing additional details of the embodiment of FIG. 7.

In the embodiment of FIG. 7, each roll end shield has internal channels 97, 99, respectively, through which a cooling fluid (e.g. water) may be circulated to cool elements 81, 82 and part of lips 51, 52. This cooling arrangement is shown in greater detail in FIG. 20, with reference to channel 99. The roll end shield containing cooling channel 99 is fixed to and rotates with roll 32. Cooling channel 99 comprises an inlet part 210 communicating with an input channel 211 on a stationary fitting or end cap 212 having an output channel 213 communicating with an outlet part 214 of channel 99. A series of O-rings 215–217 provide seals between stationary fitting 212 and the rotating roll end shield containing cooling channel 99. A series of spacer posts 218-220 maintain an interior channel wall 221 between a pair of exterior channel walls 222, 223 and help provide structural integrity. Channel 99, its parts, and fitting 212 are annular and have the same center line 224 as roll 32. Fitting 212 has an outer end 225 covered by an end plate (not shown) with openings for introducing and withdrawing cooling liquid from the fitting's respective input and output channels 211, 212. Alternatively, the cooling liquid conventionally utilized to cool roll 32 can be directed from the roll into channel 99.

The flow path of the magnetic field developed by the embodiment of FIG. 7 is similar to the flow path of the magnetic field developed by the embodiment of FIG. 5 except that elements 81, 82 replace magnetic projections 58, 59 of magnetic member 46 in defining respective parts of the magnetic field. Roll end shields 67, 68(*a*) prevent the magnetic flux entering elements 81, 82 from coming out of rear surfaces 89, 90 of elements 81, 82 and (*b*) cause the magnetic flux to flow instead through first side surfaces 85, 86 between elements 81, 82 and peripheral roll lips 51, 52.

The dimensions of lips 51, 52 in the embodiment of FIG. 7 is similar to the dimensions of lips 51, 52 in the embodiment of FIG. 4. In both embodiments, there is a small space between terminal end surfaces 53, 54 of lips 51, 52 and front surface 44 of the confining coil's first portion 42. The purpose of this space is to provide a mechanical clearance between coil front surface 44 and lip terminal end surfaces 53, 54 as lips 51, 52 rotate with casting rolls 31, 32. Except for providing that clearance, lip terminal end surfaces 53, 54 may be as close as possible to front surface 44 on the confining coil's first portion 42 (e.g. 1.25–1.5 mm). A similar clearance is provided, in the embodiment of FIG. 4, between (a) end surfaces 60, 61 on magnetic member 46 and (b) the facing surfaces 73, 74 on roll end shields 67, 68, and also between (c) the terminal end surfaces 75, 76 on coil shield 48 and (b) facing surfaces 73, 74 on roll end shields 67, 68.

In the embodiment of FIG. 7, the clearance between (a) front part 83 of element 81 and (b) end 61 on magnetic member 46 is similar to the clearance between the confining coil's front surface 44 and terminal end surfaces 53, 54 on the peripheral lips. In the case of element 82, however, the distance between its second side surface 88 and adjacent end 60 on magnetic member 46 increases as that side surface recedes from front part 84 of element 82 to rear surface 90 thereof. In the embodiment of FIG. 7, the space between second side surface 88 of element 82 and end 60 of magnetic member 46 is occupied by air, which has the same magnetic permeability as copper but zero conductivity. That space should not be occupied by any material having a high electrical conductivity. Thus, the space may be occupied by a magnetic material similar to that employed in magnetic member 46 or by a non-magnetic material, such as austenitic stainless steel; but that space may not be occupied by a material, such as copper, having high electrical conductivity.

The flow path of the magnetic field in the embodiment of FIG. 7 extends through: magnetic member 46; the space between member 46 and each of elements 81, 82; the space between front surface 44 of confining coil 42 and terminal end surfaces 53, 54 of lips 51, 52; those parts of lips 51, 52 which protrude axially outwardly beyond roll end shields 67, 68; and that part of the molten metal in gap 35 which is located between peripheral roll lips 51, 52, axially inwardly of open end 36 of gap 35. It is important that the flow path defined in the preceding sentence be composed of material having an electrical conductivity less than copper. Thus, the flow path may include: the magnetic material of magnetic member 46; the air spaces described above; the austenitic stainless steel of which peripheral roll lips 51, 52 are composed; and the austenitic stainless steel or magnetic material of which elements 81, 82 are composed. The flow path of the magnetic field is devoid of any material, such as copper, having a high electrical conductivity. Neither elements 81, 82 nor peripheral roll lips 51, 52 nor any part thereof is composed of copper or like material.

As previously noted, in the embodiment of FIG. 7 there are no mutually overlapping projections on (a) the magnetic dam and (b) the ends of the casting rolls. This eliminates a possible mechanical interference problem, arising during the rotation of the casting rolls, which may occur with the overlapping projections incorporated into the embodiment of FIG. 4. The embodiment of FIG. 13 (discussed below) also avoids this problem.

Referring now to FIGS. 1A and 3, the width of front surface 44 of the confining coil's first portion 42 tapers arcuately downwardly to a lowermost part 47 and conforms to the contour of gap 35 at open end 36. At all vertical levels on the coil, the width of front surface 44 on the coil's first portion 42 should be no less than the combined width of (1) terminal end surface 53 on lip 51, (2) open end 36 of gap 35 and (3) terminal surface 54 on lip 52 (see, e.g., FIGS. 4 and 7).

A typical width for a gap 35 is 0.10–1.0 cm, at the nip between the rolls, and the width of gap 35 increases as the height of the molten metal pool increases. The width of terminal surfaces 53, 54 on peripheral roll lips 51, 52 would be the same as the thickness of the peripheral roll lips, and this was discussed above in some detail.

Peripheral roll lips 51, 52 undergo heating during the casting operation. The heat comes from two sources: heat from the molten metal contained between the lips; and induction heat due to the time-varying magnetic field which extends through the lips. (Offsetting this heat gain is a heat loss from the lip to other parts of the casting roll.) Because each lip rotates with its respective circular casting roll 31, 32, and because only a small fraction of the circular roll's peripheral casting surface contacts molten metal pool 38 at any one time, only a small part of a lip's circumferential dimension is exposed to heating at any given time during the casting process; this part is called the intercepted angle for the lip. The maximum intercepted angle for the lip corresponds to the maximum angle of contact between molten metal pool 38 and casting rolls 31, 32. As a fraction of the 360° through which a lip traverses as its roll rotates, the maximum intercepted angle is relatively small. In effect, the maximum intercepted angle corresponds substantially to the limits of either of the two arcs defined by the two arms of the dam's magnetic member 46, shown in section in FIG. 6. In other words, the maximum intercepted angle corresponds substantially to the arcuate segment in which a point on the lip is subjected to the magnetic field, as the lip's casting roll rotates. Assuming a casting roll radius of 60 cm and a pool depth of 40 cm, the intercepted angle would be about 42°.

Notwithstanding the relative smallness of the maximum intercepted angle, peripheral lips 51, 52 undergo a substantial increase in temperature as they move through an intercepted angle (e.g. an increase of 100°–120° C.). To offset this increase in temperature, each peripheral roll lip is cooled immediately after the lip has rotated beyond the magnetic field generated by the confining coil, i.e. immediately after the intercepted angle.

Figure 6:
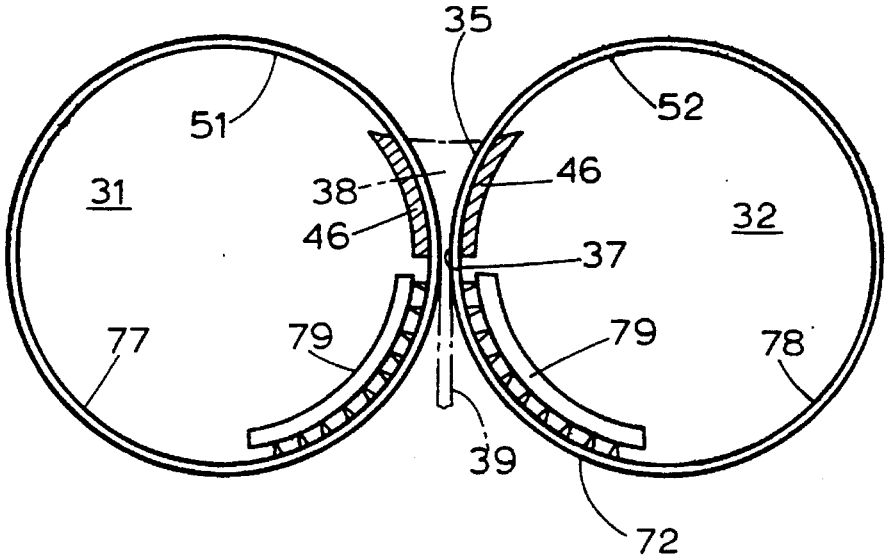
FIG. 6 is an end view illustrating a device for cooling the peripheral roll lips, in accordance with the present invention.

As shown in FIG. 6, this cooling function may be performed by a pair of arcuately shaped cooling devices 79 each located just below dam 40 and each comprising structure for directing a cooling fluid against the inner surface 77, 78 of each lip 51, 52 along an arcuate segment of that surface. Each lip's inner surface 77, 78 is located radially inwardly of a respective casting roll's peripheral surface 71, 72. The cooling fluid may be air, argon or a liquid such as chilled water, for example. The temperature of the cooling fluid, the rate at which cooling fluid is delivered, and other relevant parameters (if any), will depend at least in part upon the temperature increase which peripheral roll lips 51, 52 undergo as they move through the intercepted angle. These parameters can be determined empirically. The arcuate segment in which a rotating peripheral roll lip undergoes cooling by device 79 typically is substantially greater than the above-defined maximum intercepted angle (the maximum arcuate segment in which the lip undergoes heating), e.g. 10% to 35% greater up to several times greater (e.g. 4 to 5 times greater).

Figure 13A:
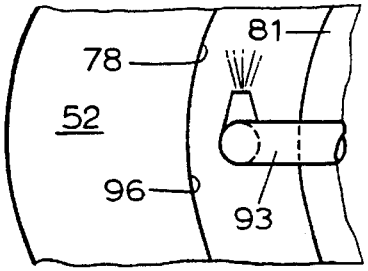
FIG. 13A is an enlarged, fragmentary end view illustrating a cooling device for a casting roll, in accordance with an embodiment of the present invention.
Figure 13:
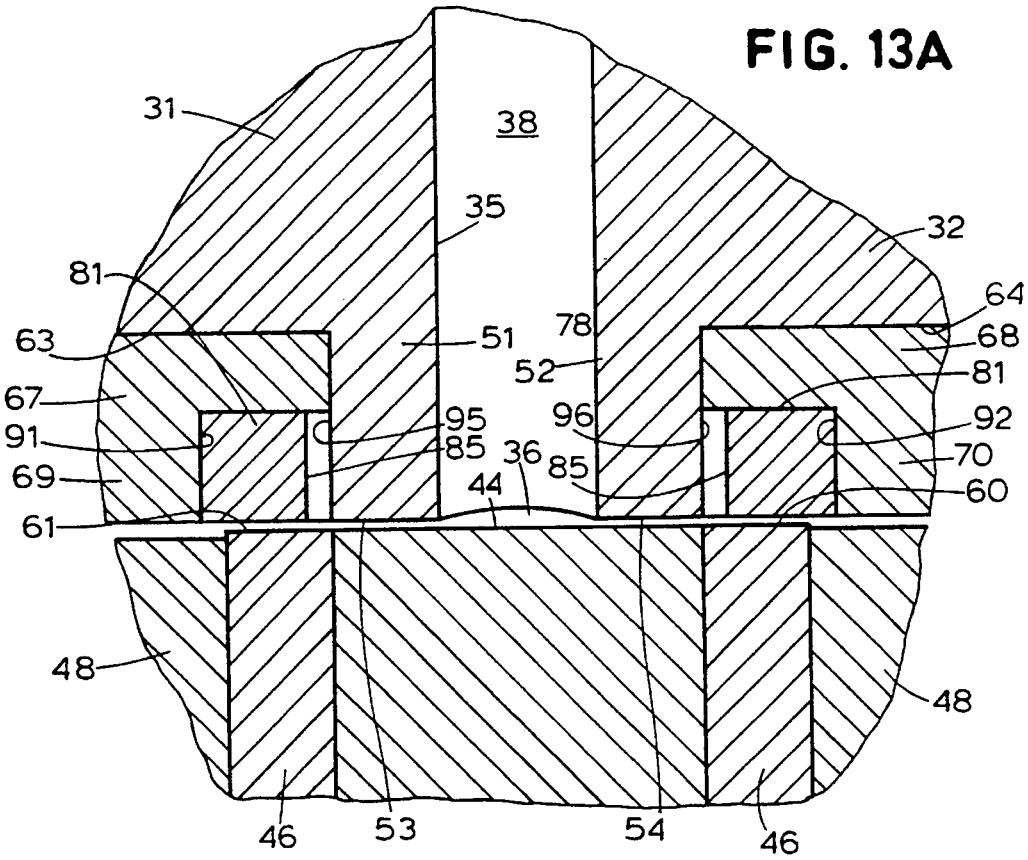
FIG. 13 is an enlarged, fragmentary sectional view similar to FIG. 7 and illustrating a portion of a further embodiment of the present invention.

Referring now to FIGS. 13 and 13*a*, as previously noted, each casting roll 31, 32 has a respective roll end shield 67, 68 adjacent the corresponding roll end 63, 64. Each roll end shield 67, 68 is located radially inwardly of the adjacent peripheral roll lip 51, 52 and covers the end 63, 64 of the corresponding casting roll 31, 32. Protruding outwardly in an axial direction from each roll end shield 67, 68 is a respective shield extension 69, 70. Each roll end shield 67, 68 and each shield extension 69, 70 is composed of non-magnetic, electrically conductive material having a relatively poor magnetic permeability compared to that of peripheral roll lips 51, 52 and the elements located alongside the peripheral roll lips. In the embodiment of FIG. 13, each element located alongside a peripheral roll lip 51, 52 is separate and discrete from any other component of apparatus 30, each has a rectangular cross-section, and each is designated by the numeral 81 in FIG. 13.

As in other embodiments, the terminal end surface 53, 54 of each peripheral roll lip 51, 52 protrudes outwardly from its corresponding casting roll 31, 32, in an axial direction, beyond the corresponding roll end 63, 64. Each roll end shield 67, 68 and its respective extension 69, 70 comprise structure for substantially preventing the magnetic field generated by the confining coil from following a flow path other than across gap 35 adjacent its open end 36.

Each peripheral roll lip 51, 52 and the corresponding roll end shield extension 69, 70 define therebetween an annular space 91, 92 respectively. Each element 81 located alongside a peripheral roll lip 51, 52 comprises an annular member located in a respective annular space 91, 92. As previously noted, each arm of magnetic member 46 has an end or front surface 60, 61, respectively; each such front surface faces one of the annular members 81. Each front surface 60, 61 of magnetic member 46 is disposed along a segment of the arcuate path followed by annular member 81 as its casting roll 31, 32 rotates. This segment is shown in cross-section at 46 in FIG. 6 and corresponds substantially to the maximum intercepted angle for a peripheral roll lip.

Each annular space 91, 92 is substantially, completely filled by annular member 81. In some embodiments, annular space 91 or 92 may be totally filled by annular member 81. In other embodiments, one may provide a gap 95, 96 in annular space 91, 92 respectively. Gap 95 or 96 is located between (a) a peripheral roll lip 51, 52 and (b) the first side surface 85 of an adjacent annular member 81. Gaps 95, 96 comprise structure for receiving a jet of cooling gas for cooling an adjacent peripheral roll lip 51, 52 as the lip moves through an intercepted angle for the lip. FIG. 13A illustrates a device 93 for directing a jet of cooling gas into a gap 96. The cooling gas may be air, or it may be an inert gas such as argon, for example.

Roll end shields 67, 68 and their respective extensions 69, 70 are all preferably composed of copper and water-cooled (not shown). Peripheral roll lips 51, 52 are preferably composed of non-magnetic, austenitic stainless steel. Annular members 81 may be composed of the same material as magnetic member 46, or they may be composed of non-magnetic stainless steel similar to that used for peripheral roll lips 51, 52.

Figure 11:
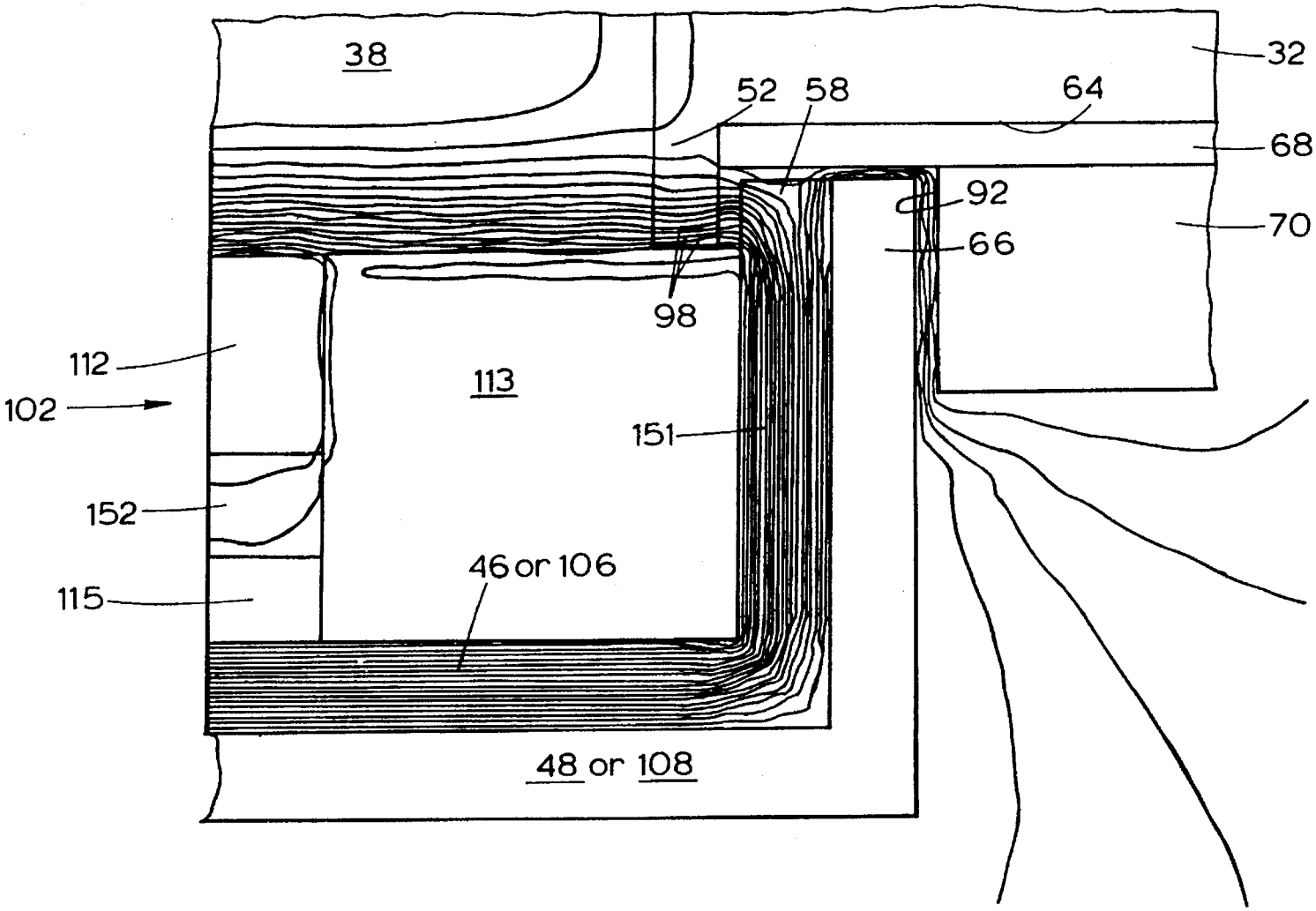
FIG. 11 is an enlarged, fragmentary view, similar to FIG. 5, showing the magnetic field developed by another embodiment of a strip casting apparatus with electromagnetic confining dam, in accordance with the present invention.

FIG. 11 illustrates another embodiment in accordance with the present invention, similar in some respects to the embodiment illustrated in FIG. 13, but without annular members 81 substantially filling annular spaces 91, 92. In the embodiment of FIG. 11, an annular space such as 92 is substantially filled by a pair of projections, one extending from an arm of magnetic member 46 and one extending from an arm of coil shield 48. More particularly, each arm of magnetic member 46 has a projection, e.g. 58, and each arm of coil shield 48 has a projection, e.g. 66; each such projection 58, 66 protrudes beyond the front surface of the confining coil and into the annular space 92 defined between (a) peripheral roll lip 52 and (b) extension 70 of adjacent roll end shield 68.

In this embodiment (FIG. 11), projection 58 of magnetic member 46 replaces and performs a function of annular member 81, of FIG. 13, e.g., projection 58 constitutes part of the flow path of the magnetic field which flows from magnetic member 46 through peripheral roll lip 52. The magnetic field developed by the embodiment of FIG. 11 is depicted by magnetic field lines 98. (Section lines have been deleted in FIG. 11, for clarity purposes.) In effect, extension 58 on magnetic member 46 incorporates that arcuate segment of annular member 81 which, in the embodiment of FIG. 13, was disposed adjacent molten metal pool 38.

Projection 58 on magnetic member 46 and projection 66 on coil shield 48 (FIG. 11) each protrude beyond the front surface of the confining coil of the magnetic dam a distance between one and three skin depths (δ) of the molten metal in pool 38. In this regard, the relevant skin depth is expressed as follows:

$$\delta = \sqrt{2/\omega\mu\sigma}$$

where

δ is the skin depth of the molten metal

ω is 2πf f is the frequency of the time-varying current to be employed

μ is the magnetic permeability of air

σ is the electrical conductivity of the molten metal.

As shown in FIG. 11, extension 70 of roll end shield 68 protrudes further outwardly in an axial direction than does the adjacent peripheral roll lip 52. Roll end shield 68, roll end shield extension 70, coil shield 48 and coil shield projection 66 are all preferably composed of copper. Peripheral roll lip 52 is preferably composed of non-magnetic stainless steel. Roll end shield 68 and its extension 70 substantially prevent the magnetic field from flowing outside the area where containment of the molten metal is desired, thereby reducing leakage of the magnetic field.

Peripheral roll lip 52 in the embodiment of FIG. 11 has a thickness (dimension in a radial direction) and an exposed length akin to those of peripheral roll lip 52 in the embodiment of FIG. 4 (described above). These same parameters are applicable to all embodiments of the present invention having peripheral roll lips.

Referring now to FIGS. 8–12 and 14–16, the embodiments of the present invention illustrated in these figures employ an electromagnetic containment dam comprising a multi-piece confining coil. Indicated generally at 100 in FIGS. 8–10 and 12 is an electromagnetic dam which, like dam 40 of FIGS. 1–3, is for preventing the escape of molten metal through open end 36 of vertically extending gap 35 located between two horizontally disposed, counter-rotating casting rolls 31, 32 containing therebetween a pool 38 of molten metal. Dam 100 includes a confining coil having a first part 102 for disposition adjacent casting rolls 31, 32. Confining coil first part 102 comprises (a) a first, vertically disposed, central conductor portion 112 having a pair of opposite sides 126, 127 and (b) a pair of wedge-shaped, vertically disposed conductor portions 113, 114 each located on a respective opposite side 126, 127 of first central conductor portion 112, in close, substantially abutting relation thereto. Wedge-shaped conductor portions 113, 114 are electrically insulated from first central conductor portion 112 by a film of insulating material (not shown).

Figure 9:
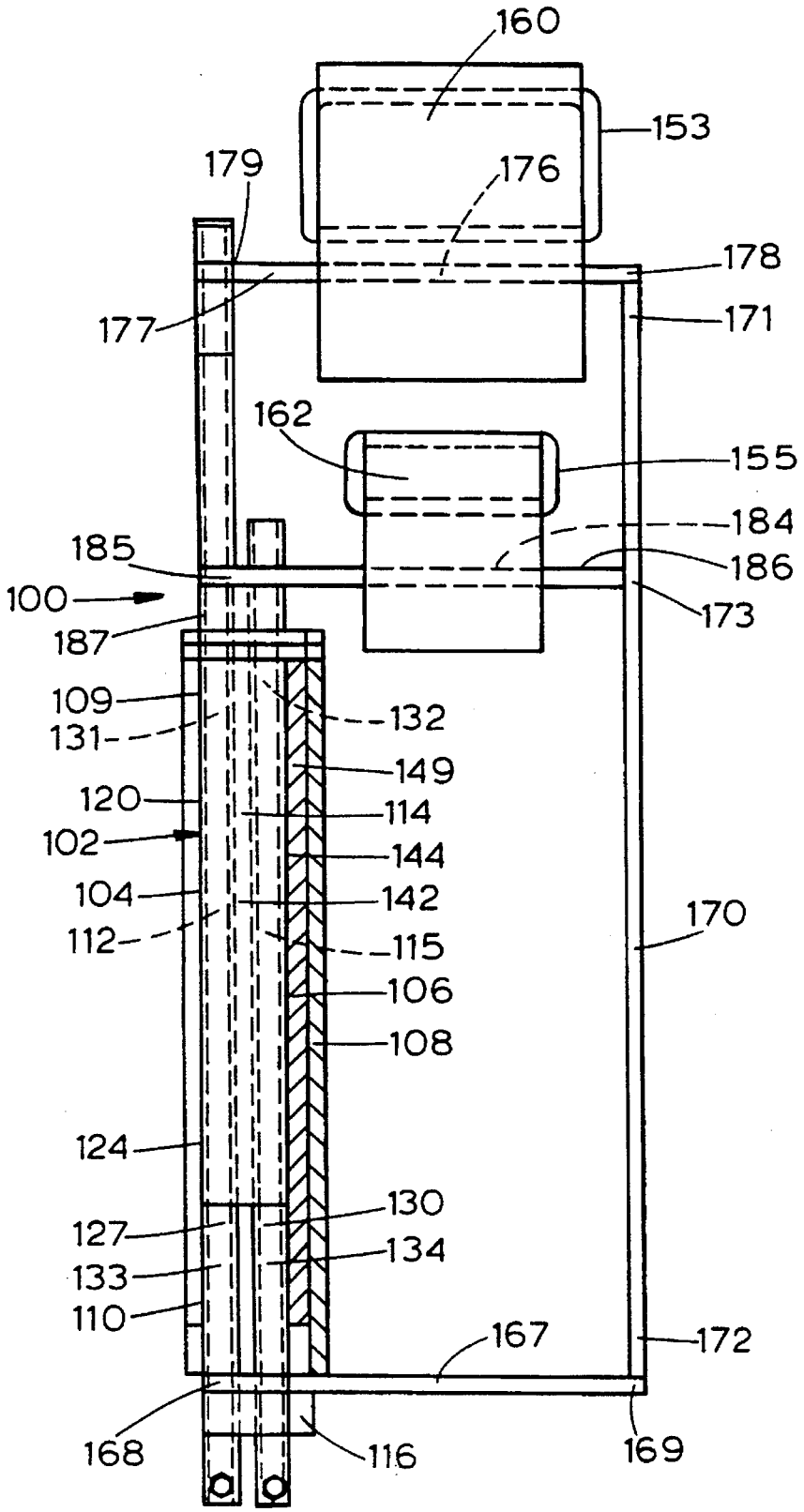
FIG. 9 is a side view of the dam of FIG. 8, partially in section.
Figure 10:
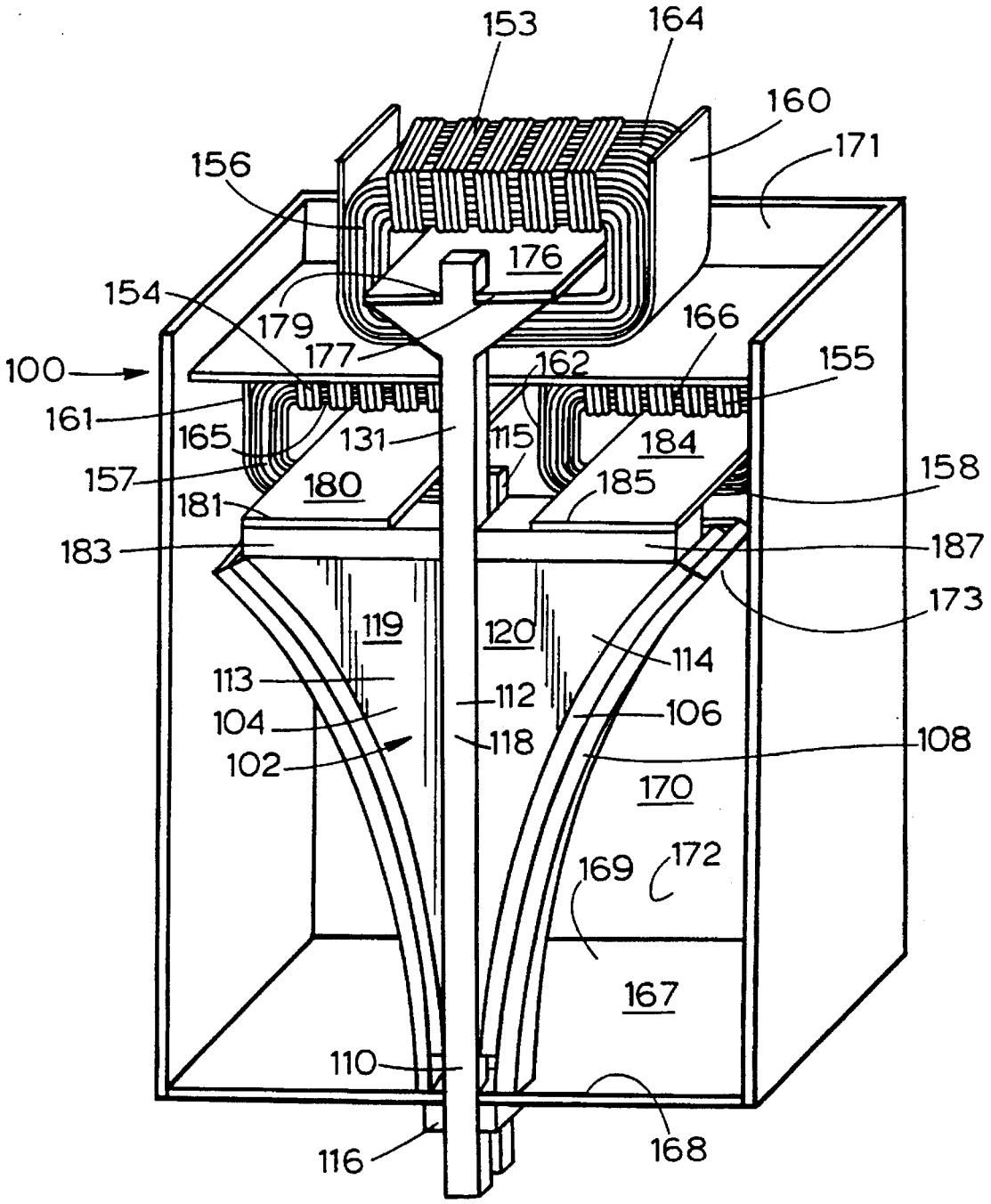
FIG. 10 is a perspective of the dam of FIGS. 8 and 9.
Figure 12:
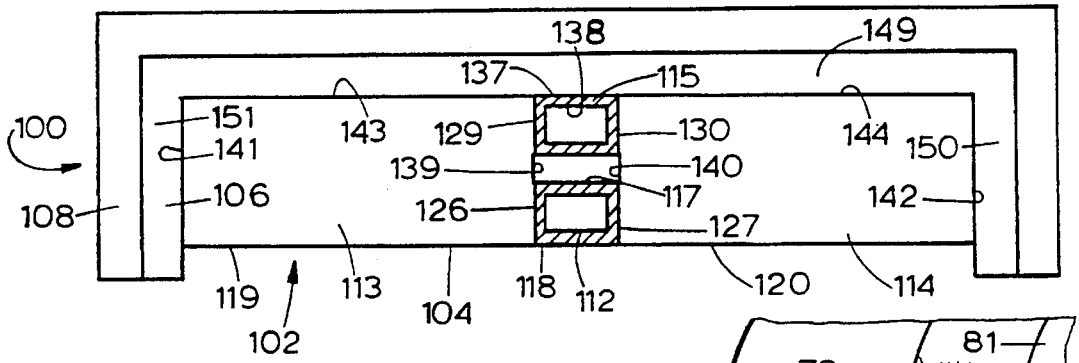
FIG. 12 is a fragmentary plan view of the dam of FIGS. 8–10.

A second, relatively narrow, elongated, vertically disposed central conductor portion 115 is located directly behind and spaced from first central conductor portion 112 (FIGS. 9 and 12). Second central conductor portion 115 constitutes a portion of the confining coil's first part 102 and comprises a pair of opposite sides 129, 130 (FIG. 12) each in electrically conductive, abutting relation with a respective wedge-shaped portion 113, 114. First central conductor portion 112 has an upper part 131 and a lower part 133. Similarly, second central conductor portion 115 has an upper part 132 and a lower part 134 (FIG. 9). Electrically connecting lower parts 133, 134 of central conductor portions 112 and 115, respectively, is a bottom conductor portion 116 having a substantial horizontal directional component.

First central conductor portion 112 has a relatively narrow front surface 118 disposed between opposite sides 126, 127 of conductor portion 112. Front surface 118 faces open end 36 of gap 35 and has a lowermost part 125. Each wedge-shaped conductor portion 113, 114 has a respective front surface 119, 120 tapering in width from a relatively wide upper part 121, 122 respectively to a relatively narrow lowermost part 123, 124 respectively. Front surfaces 119, 120 of wedge-shaped conductor portions 113, 114 face open end 36 of gap 35. Front surfaces 118–120 of conductor portions 112–114 constitute the front surface 104 of the confining coil's first part 102. Front surface 104 has a relatively wide upper part 109, for positioning opposite the wide top part **38*a* of molten metal pool 38 when the pool is at a predetermined maximum height (see FIG. 1A). Wide upper part 109 includes, as constituents, (a) wide upper parts 121, 122 on front surfaces 119, 120 of wedge-shaped conductor portions 113, 114 and (b) front surface 118 of first central conductor portion 112. Front surface 104 tapers in width from upper part 109 to a relatively narrow lowermost part 110, for positioning opposite (a) nip 37 between rolls 31, 32 (FIG. 1) and (b) the narrow, lower part 38b of molten metal pool 38 (FIG. 1A). Lowermost part 110 of front surface 104 corresponds essentially to lowermost part 125 of front surface 118 on first central conductor portion 112**.

Circuitry is provided for flowing, through first central conductor portion 112, a first time-varying current having a pre-selected amperage. Other circuitries are provided for flowing, through one wedge-shaped conductor portion, e.g. 113, a second time-varying current, separate and distinct from the time-varying current which flows through first central conductor portion 112. Further circuitry is provided for flowing, through the other wedge-shaped conductor portion 114, a third time-varying current, separate and distinct from the first and second time-varying currents described in the preceding two sentences. The second and third time-varying currents each have a respective pre-selected amperage which can differ from the pre-selected amperage of the first time-varying current. The confining coil's first part 102 is defined in this embodiment by conductor portions 112–114. The flow of electric current through first part 102 generates a horizontal magnetic field which exerts a magnetic confining pressure on molten metal pool 38 at the open end 36 of gap 35 (see FIG. 11).

As shown in FIG. 12, each of the conductor portions 112, 113 and 114 has other surfaces, in addition to their respective front surfaces 118–120. Dam 100 comprises a magnetic member 106 for preventing a time-varying current from flowing along any of those surfaces other than front surfaces 118–120, at predetermined vertical levels on conductor portions 112, 113 and 114. Magnetic member 106 substantially encloses the confining coil's first part 102 (i.e. coil portions 112, 113, 114 and 115), except for front surface 104. Magnetic member 106 defines a low reluctance return path for the magnetic field generated by the confining coil (FIG. 11). Dam 100 also comprises a shield 108 composed of non-magnetic, electrically conductive material (e.g. copper). Shield 108 substantially encloses magnetic member 106 and comprises structure for confining that part of the horizontal magnetic field which is outside of the low reluctance return path defined by magnetic member 106, to substantially a space adjacent open end 36 of gap 35.

Referring now to FIGS. 8–9, 12 and 14–15, first central conductor portion 112 has a rear surface 117. Second central conductor portion 115 has a rear surface 137 and a front surface 138. Each wedge-shaped conductor portion 113, 114 has a respective inner side surface 139, 140, in close, substantially abutting relation (a) with a respective opposite side 126, 127 of first central conductor portion 112 and (b) with opposite sides 129, 130 of second central conductor portion 115. Each wedge-shaped conductor portion 113, 114 has a respective arcuate outer surface 141, 142. The curvature on arcuate outer surfaces 141, 142 conforms to the radius of casting rolls 31, 32 with which dam 100 is employed. Each wedge-shaped portion 113, 114 also has a respective rear surface 143, 144.

Figure 14:
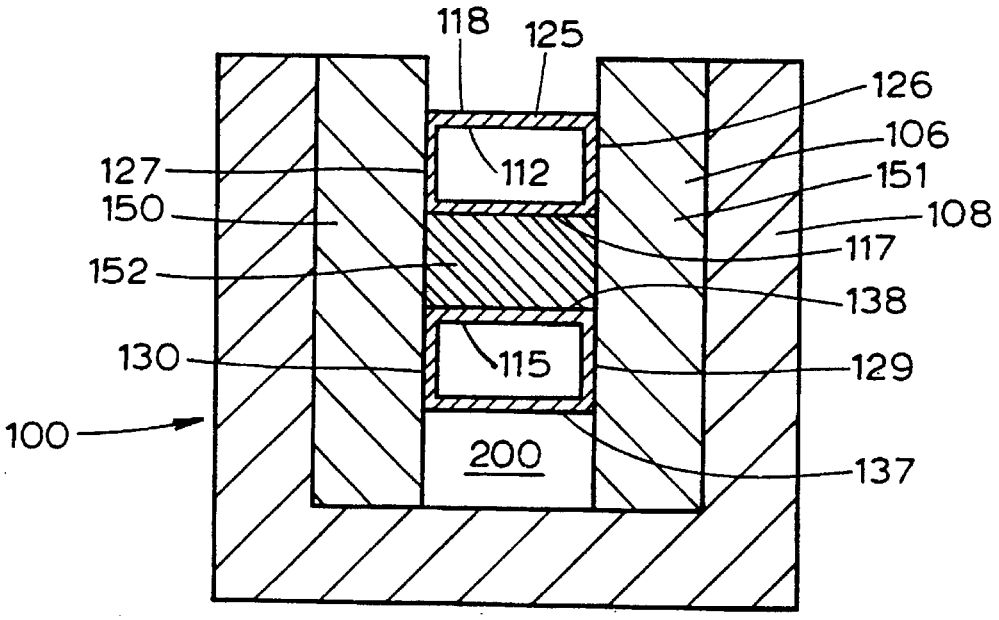
FIG. 14 is an enlarged sectional view taken along line 14-14 in FIG. 8.
Figure 15:
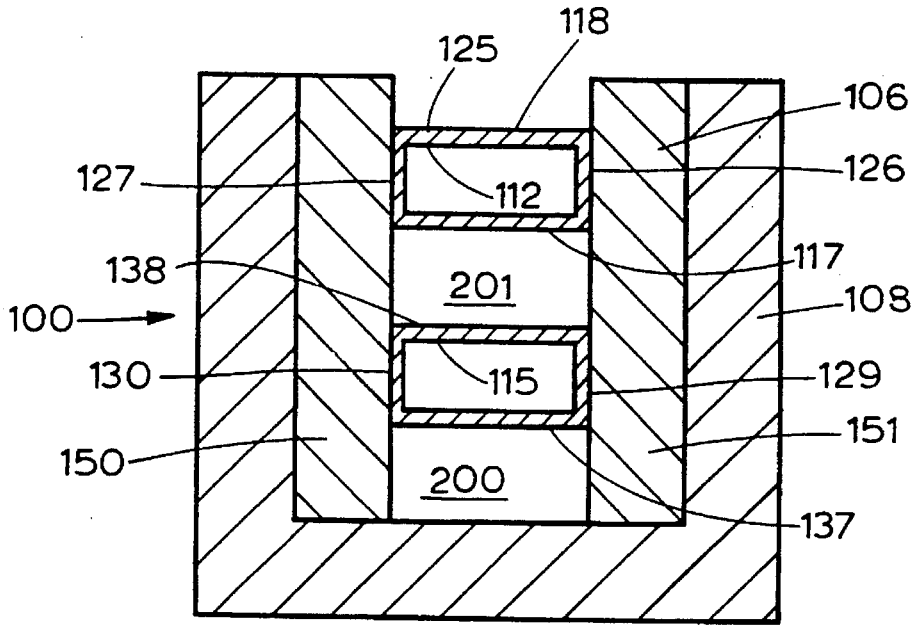
FIG. 15 is a view similar to FIG. 14.

As shown in FIGS. 12 and 14–15, magnetic member 106 comprises a rear part 149 (FIG. 12) integral with a pair of side parts 150, 151, and a cross part 152 (FIG. 14) extending between side parts 150, 151 forward of the magnetic member's rear part 149. Cross part 152 is disposed between first and second central conductor portions 112 and 115. The magnetic member's rear part 149 abuts rear surface 137 on second central conductor 115, rear surface 143 on wedge-shaped portion 113 and rear surface 144 on wedge-shaped portion 114. The magnetic member's side parts 151, 150 are in abutting relation with outer surfaces 141, 142 on wedge-shaped conductor portions 113, 114 respectively. The magnetic member's cross part 152 is in abutting relation with rear surface 117 on first central conductor portion 112 and with front surface 138 on second central conductor portion 115.

As a result of the abutting relationships described in the preceding paragraph, the various parts of magnetic member 106 substantially prevent time-varying currents from flowing along any of the surfaces of the aforementioned conductor portions other than front surface 118 of first central conductor portion 112 and front surfaces 119, 120 on wedge-shaped conductor portions 113,114 respectively. Cross part 152 substantially prevents current from flowing along the facing surfaces of first and second central conductor portions 112, 115, namely rear surface 117 of first central conductor portion 112 and front surface 138 on second central conductor portion 115 (FIGS. 14 and 15).

As previously noted, magnetic member 106 is electrically insulated from the confining coil's first part 102 by a film of electrical insulating material. A similar film of electrical insulating material can be employed to insulate magnetic member 106 from coil shield 108. Preferably however, there is no insulation between magnetic member 106 and coil shield 108; this enables better thermal conduction between relatively hot member 106 and cooler shield 108 (which can be liquid-cooled) and helps prevent over-heating of magnetic member 106 during operation of dam 100. To the extent that there may be some electrical shorting between coil shield 108 and magnetic member 106, such shorting is not sufficiently bothersome to preclude elimination of an insulating film between magnetic member 106 and coil shield 108.

Figure 8:
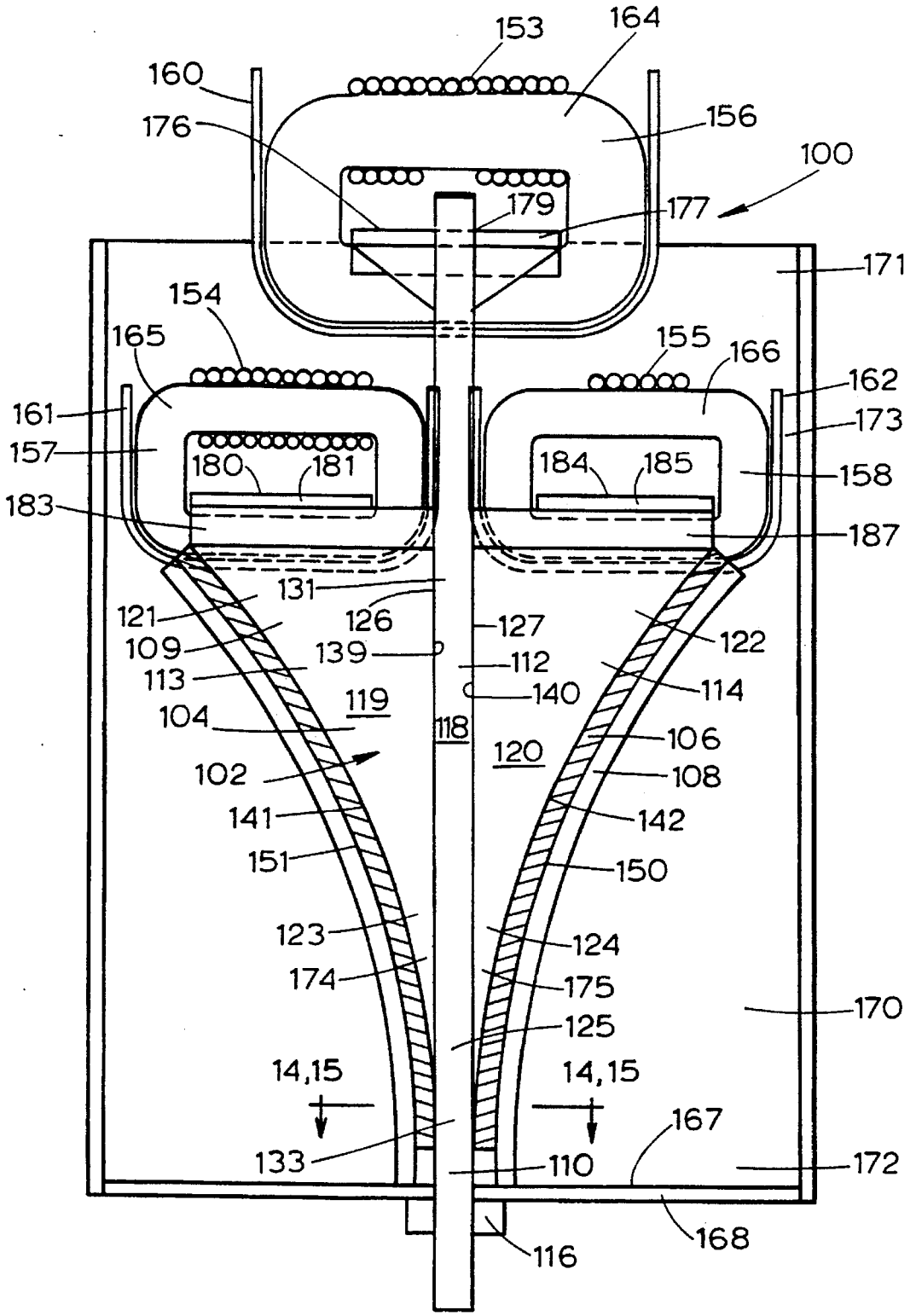
FIG. 8 is an end view of an embodiment of an electromagnetic confining dam employing a multi-piece confining coil, in accordance with the present invention.

Each inner surface 139, 140 on wedge-shaped conductor portions 113, 114 respectively is in electrically conductive, abutting relation with a respective side surface 129, 130 of second central conductor portion 115. Each arcuate outer surface 141, 142 on wedge-shaped conductor portions 113, 114 respectively converges downwardly toward its corresponding inner surface 139, 140 (FIG. 8). A rear surface 143, 144 extends between the inner and outer surfaces of each wedge-shaped conductor portion 113, 114 respectively (FIG. 12).

Second central conductor portion 115 has its lowermost part 134 substantially vertically co-extensive in a downward direction with lowermost part 133 of first central conductor portion 112 (FIG. 9). Front surface 125 of lowermost part 133 of the first central conductor portion (FIG. 8) faces (a) open end 36 of gap 35 at nip 37 between casting rolls 31, 32 (FIG. 1) and (b) lower part 38a of molten metal pool 38 (FIG. 1A). Each of the lowermost parts 123, 124 on the front surface of a wedge-shaped conductor portion 113, 114 is disposed above lowermost part 125 of the front surface on first central conductor portion 112 (FIG. 8).

The confining coil's first part 102 has a rear surface defined by rear surfaces 143, 144 of wedge-shaped portions 113, 114 respectively and by rear surface 137 on second central conductor portion 115. Outer side surfaces 141, 142 of wedge-shaped conductor portions 113,114, respectively, define opposite side surfaces for the confining coil's first part 102. These opposite side surfaces extend between the aforementioned rear surface of first part 102 and the first part's front surface defined by (a) front surface 118 of first central conductor portion 112 and (b) front surfaces 119, 120 of wedge-shaped conductor portions 113, 114 respectively. The rear part 149 and the side parts 150, 151 of magnetic member 106 are in close, substantially abutting relation with the aforementioned rear surface and side surfaces of the confining coil's first part 102, thereby substantially preventing time-varying electric current from flowing over these surfaces.

As previously noted, separate and discrete time-varying electric currents are flowed through each of first central conductor portion 112, wedge-shaped conductor portion 113 and wedge-shaped conductor portion 114. In accordance with one embodiment of the present invention, the separate currents flowing through each of wedge-shaped conductor portions 113, 114 each have a pre-selected amperage less than the pre-selected amperage of the separate current flowing through first central conductor portion 112. The relevant circuitry is illustrated in FIGS. 8–10 and 16.

Dam 100 includes three transformers structurally integrated into the dam. Each transformer supplies a respective time-varying current to a respective one of conductor portions 112–114. Each transformer comprises a respective primary coil 153–155. More particularly, primary coil 153 is part of the transformer for supplying time-varying current to first central conductor portion 112; primary coil 154 is part of the transformer for supplying a time-varying current to wedge-shaped conductor portion 113; and primary coil 155 is part of the transformer for supplying time-varying current to wedge-shaped conductor portion 114. Associated with each primary coil 153–155 is a loop-shaped magnetic core 156–158 respectively. Each magnetic core has a respective first-portion 164–166 extending through a corresponding primary coil 153–155.

A major part of each of the transformers described above is mounted directly above, slightly to the rear of, and in close proximity to the conductor portion supplied with current by that transformer, to substantially reduce external power losses, compared to more remotely located transformers connected to dam 100 by bus bars. More particularly, dam 100 includes three U-shaped mounting brackets 160–162. Mounting bracket 160 supports transformer parts 153 and 156 associated with first central conductor portion 112; mounting bracket 161 supports transformer parts 154 and 157 associated with wedge-shaped conductor portion 113; and mounting bracket 162 supports transformer parts 155 and 158 associated with wedge-shaped conductor portion 114. Bracket 160 is mounted above and adjacent first central conductor portion 112; bracket 161 is mounted above and adjacent wedge-shaped conductor portion 113; and bracket 162 is mounted above and adjacent wedge-shaped conductor portion 114. Structural connections for positioning brackets 160–162 in the positions illustrated in FIG. 8–9 and described above, are conventional in nature and within the skill of the art.

Each of the three transformers described above includes, as part of its secondary coil, a respective one of the conductor portions 112–114. More particularly, with respect to the transformer of which the primary coil is 153, first central conductor portion 112 is part of the secondary coil of that transformer. With respect to the transformer of which the primary coil is 154, wedge-shaped conductor portion 113 is part of the secondary coil. With respect to the transformer of which the primary coil is 155, the secondary oil includes wedge-shaped conductor portion 114.

The other components which made up the three secondary coils will now be described in more detail with reference to FIGS. 8–10 and 16.

Located at the bottom of dam 100 is a lower conductor portion 167 having a front part 168 and rear part 169. Lower conductor portion 167 has a substantial horizontal directional component. Front part 168 of lower conductor portion 167 is electrically connected to the lower parts 133, 134 of first and second central conductor portions 112, 115 by bottom conductor portion 116 which, as previously noted, electrically connects lower parts 133, 134 of central conductor portions 112, 115 respectively. Rear part 169 of lower conductor portion 167 is electrically connected to the lower part 172 of a substantially vertically disposed rear conductor portion 170 spaced behind second central conductor portion 115.

The components for the secondary coil associated with primary coil 153, in addition to first central conductor portion 112, include a first upper conductor portion 176 having a substantial horizontal directional component and comprising a back part 178 electrically connected at 179 to an upper part 171 of vertically disposed rear conductor portion 170. First upper conductor portion 176 also includes a front part 177 electrically connected at 179 to upper part 131 of first central conductor portion 112.

The components of the secondary coil associated with primary coil 154 include, in addition to wedge-shaped conductor portion 113, a second upper conductor portion 180 having a substantial horizontal directional component and comprising a back part 182 electrically connected to another part 173 of rear conductor portion 170, below the connection of the latter to back part 178 of first upper conductor portion 176. Second upper conductor portion 180 also includes a front part 181 electrically connected to an upper part 183 of wedge-shaped conductor portion 113.

The components of the secondary coil associated with primary coil 155 include, in addition to wedge-shaped conductor portion 114, a third upper conductor portion 184 having a substantial horizontal directional component and comprising a back part 186 electrically connected to part 173 of rear conductor portion 170. Third upper portion 184 also includes a front part 185 electrically connected to upper part 187 of wedged-shaped conductor portion 114.

Each upper conductor portion 176, 180 and 184 extends through a respective loop-shaped magnetic core 164, 165 and 166.

Each wedge-shaped conductor portion 113, 114 has a respective lower part 174, 175 spaced above lower conductor portion 167. Upper part 132 of second central conductor portion 115 is spaced below upper conductor portions 176, 180, 184 (FIG. 9).

Wedge-shaped conductor portions 113, 114 are in abutting, electrically conductive relation with second central conductor portion 115 over substantially the entire length of each wedge-shaped conductor portion 113, 114; but wedge-shaped conductor portions 113, 114 are electrically insulated from first central conductor portion 112 by a thin film of insulating material (not shown), over the entire vertical dimension of the wedge-shaped conductor portions.

In summary, the secondary coil associated with primary coil 153 comprises first central conductor portion 112, bottom conductor portion 116, horizontally disposed lower conductor portion 167, vertically disposed rear conductor portion 170 and horizontally disposed first upper conductor portion 176. The secondary coil associated with primary coil 154 comprises wedge-shaped conductor portion 113, lower part 134 of second central conductor portion 115, bottom conductor portion 116, horizontally disposed lower conductor portion 167, vertically disposed rear conductor portion 170 and horizontally disposed second upper conductor portion 180. The secondary coil associated with primary coil 155 comprises wedge-shaped conductor portion 114, lower part 134 of second central conductor portion 115, bottom conductor portion 116, horizontally disposed lower conductor portion 167, vertically disposed rear conductor portion 170 and horizontally disposed third upper conductor portion 184.

Figure 16:
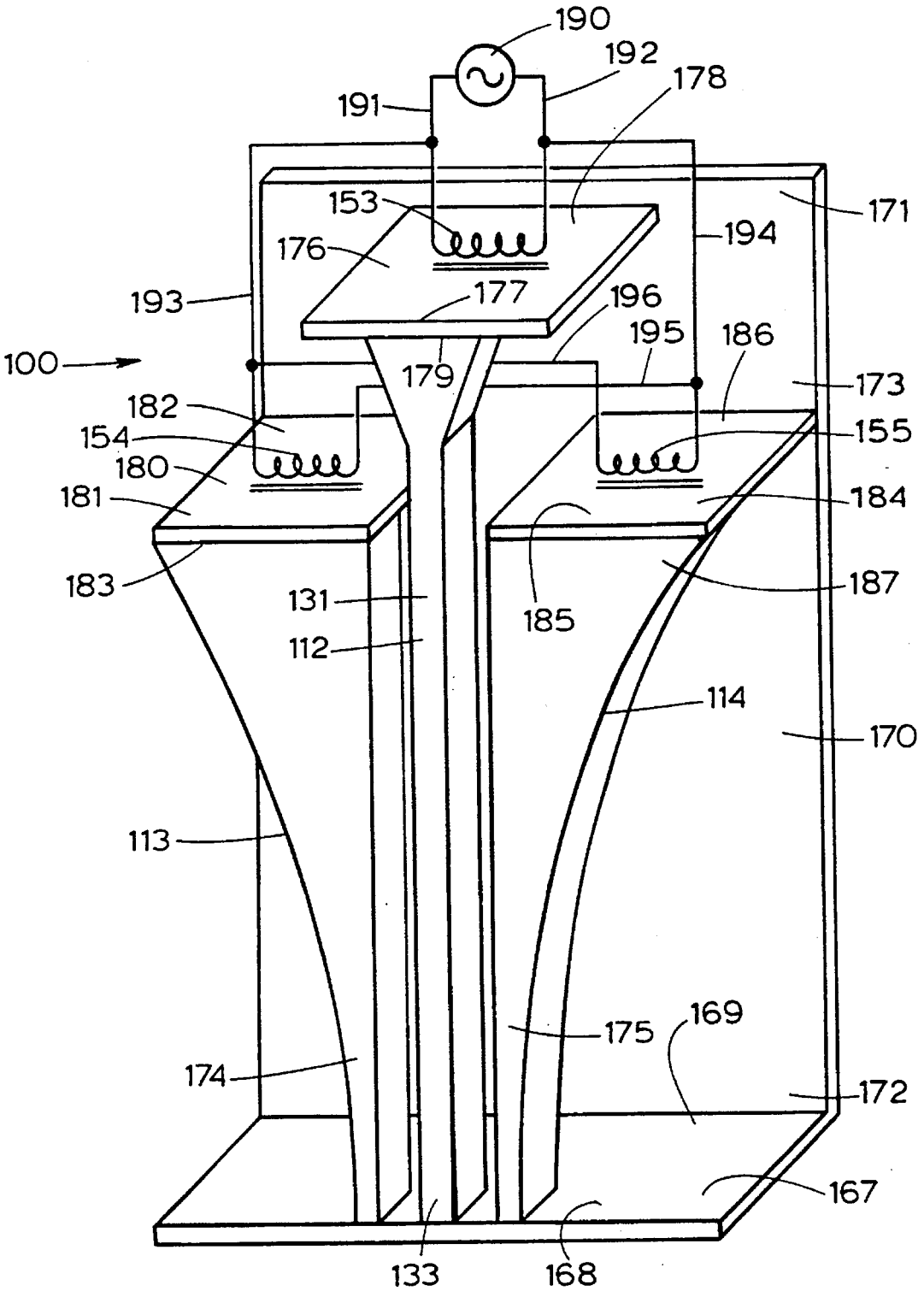
FIG. 16 is a schematic diagram, partially in perspective, illustrating the electrical circuits employed in the electromagnetic confining dam of FIGS. 8–10.

Referring now to FIG. 16, a source 190 of time-varying current is connected to primary transformer coil 153 by lines 191, 192. Current source 190 is connected to primary transformer coil 154 by lines 193, 194 and 195. Current source 190 is connected to primary transformer coil 155 by lines 193, 194 and 196. All primary coils 153-155 are connected in parallel so that the currents which flow through each of these primary coils are in phase with each other.

As previously noted, the current flowing through front surface 118 of first central conductor portion 112 can be substantially greater than the current flowing along respective front surfaces 119, 120 of wedge-shaped conductor portions 113, 114. For example, in one embodiment, the current flowing along front surface 118 of first central conductor portion 112 is about 10,000 A; while the current flowing along each of front surfaces 119, 120 of wedge-shaped conductor portions 113, 114 is about 5,000 A each. Thus, the total current flowing along front surface 104 of confining coil first part 102 (a front surface composed of all of front surfaces 118–120 of coil portions 112–114) is 20,000 A. Referring to FIG. 1A, that total current will develop sufficient magnetic flux density and sufficient magnetic pressure to contain molten metal pool 38 at its wide top part 38*a* when pool 38 is at a typical predetermined maximum height (depth). For example, assuming a casting roll radius of 60 cm and a typical pool depth of 40 cm, pool top part 38*a* will be 31 cm wide.

Assuming the same pool dimensions and amperages described in the preceding paragraph, the current flowing through lowermost part 125 on front surface 118 of first central conductor portion 112 is only 10,000 A. That amount of current is generally enough to develop a magnetic flux density and a magnetic pressure sufficient to contain narrow lower part 38*b* of molten metal pool 38, located at nip 37 between casting rolls 31, 32, where the pool is typically only about 0.10–1.0 cm wide. Under those conditions, the magnetic flux density and the magnetic pressure exerted by the confining coil's first part 102 at nip 37 are not so high as to cause undesirable turbulence in the molten metal adjacent the nip.

The total current flowing through lower conductor portion 167 of dam 100 is equal to the sum of the currents flowing through all of central conductor portion 112 and the two wedge-shaped portions 113, 114. The same total current flows upwardly through rear conductor portion 170 to the vertical level of second and third upper conductor portions 181 and 184. Above that vertical level, the current flowing through rear conductor portion 170 is equal to the current flowing through first central conductor portion 112.

Each wedge-shaped conductor portion 113, 114 is separately fed with current, and each is at the same electrical potential. As a result, each conductor portion 113, 114 conducts current substantially independently of the other.

Further expedients, in addition to that described in the third and fourth paragraphs above, may be employed to reduce the magnetic flux density and magnetic pressure generated at lowermost part 133 of central conductor portion 112, thereby to reduce the turbulence created in the adjacent facing part 38*a* of molten metal pool 38. Examples of such expedients are described in the next four paragraphs.

Referring now to FIG. 14, this is a horizontal cross-section of relevant parts of electromagnetic dam 100 at a location facing nip 37, or slightly thereabove. As shown in FIG. 14, there is a first air gap 200 in the magnetic member's rear part 149, a part which is normally in substantially abutting relation with the rear surfaces of the confining coil's first part 102; these rear surfaces comprise: (a) rear surfaces 143, 144 on wedge-shaped conductor portions 113, 114 respectively; and (b) rear surface 137 on second central conductor portion 115 (FIG. 12). The presence of air gap 200 reduces the current flowing along front surface 118 of first central conductor portion 112 at the lowermost part 125 of front surface 118 (FIG. 8).

One can obtain a further reduction in current flow along front surface 118 of first central conductor portion 112, at the lowermost part 125 of front surface 118, by employing a second air gap 201 in the space normally occupied by magnetic member cross part 152 (compare FIG. 14 and FIG. 15). Reducing the current flowing along front surface 118, at 125, reduces the magnetic flux density and magnetic pressure generated there and correspondingly reduces the turbulence created in the adjacent facing part 38*a* of molten metal pool 38 (FIG. 1A).

In other words, employing air gap 200, or both of air gaps 200 and 201, reduces (a) the magnetic confining pressure exerted by lowermost part 133 of first central conductor portion 112, compared to (b) the magnetic confining pressure exerted by first central conductor portion 112 at a location above lowermost part 133. (As used herein, the lowermost part 133 of first central conductor portion 112 includes that part of conductor portion 112 opposite nip 37 between casting rolls 31, 32 and that part of first central conductor portion 112 slightly thereabove.)

In another embodiment in accordance with the present invention, first air gap 200 is one of a plurality of similar air gaps in magnetic member rear part 149, these air gaps being at a plurality of vertically spaced locations on magnetic member 106. Each air gap above first air gap 200 reduces the current flowing along each front surface 118, 119, 120 of a corresponding conductor portion 112, 113, 114 at the same vertical level as the corresponding air gap, thereby reducing the heat generated on that front surface at that level. In a further embodiment of the present invention, a similar plurality of vertically spaced air gaps 201 may be employed together with a plurality of air gaps 200 to further reduce the current flowing along each front surface of a conductor portion at the same vertical levels as the air gaps, thereby further reducing the heat generated there.

Figure 19:
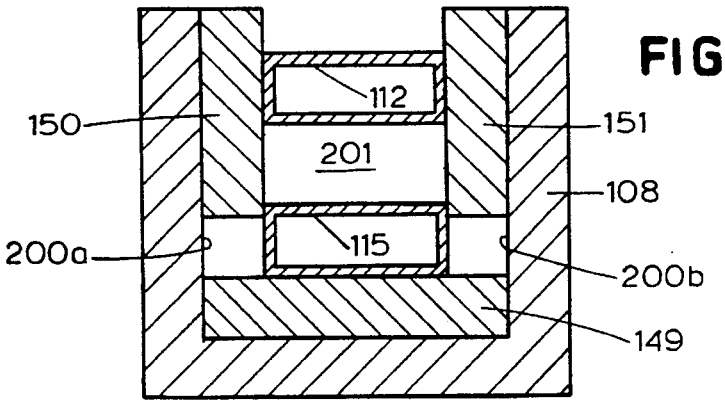
FIG. 19 is an enlarged sectional view, similar to FIGS. 14 and 15, and showing a variation of the structure shown in FIGS. 14 and 15.

Referring now to FIG. 19, in a further variation in accordance with the present invention, air gap 200 is replaced by air gaps 200*a* and 200*b* located in the spaces normally occupied by the rear portions of side parts 150, 151 of magnetic member 106. The space occupied by our gap 200 in the embodiments of FIGS. 14 and 15 is occupied by the magnetic member's rear part 149 in the embodiment of FIG. 19. Air gaps 200*a* and 200*b* perform a function similar to that performed by air gap 200.

As noted above, the current for dam 100 is supplied through three separate transformers and flowed in three separate current flows through three separate conductor portions (112, 113 and 114). As a result, the power loss due to the operation of magnetic dam 100 is substantially lower than the power loss which would occur if the same total current (e.g. 20,000 A) were flowed through a single conductor portion and supplied from a single transformer. Narrow lowermost part 110 of front surface 104 of the confining coil's front part corresponds to lowermost part 125 of front surface 118 of first central conductor portion 112. The current flow through (a) lowermost surface part 110 is substantially less than the total current flow through (b) front surface 104 of the confining coil's first part 102 (corresponding to front surfaces 118–120 on conductor portions 112–114). For example, there would be 10,000 A flowing through (a) versus 20,000 A flowing through (b). As a result, there is much less likelihood of overheating (a) than if there were a single transformer and a single current flow. In the latter case, the current flow through (a) would be substantially the same as the total current flow through (b), and (a) would likely be overheated.

First and second central conductor portions 112, 115 and bottom conductor portion 116 are hollow rectangular tubes through which a cooling fluid (e.g. water) may be circulated, employing conventional inlet and outlet conduits (not shown). Wedge-shaped conductor portions 113, 114 are provided with internal cooling channels (not shown) of a conventional nature and through which cooling fluid may be circulated employing conventional inlet and outlet conduits (not shown). As noted above, the three secondary transformer coils of which conductor portions 112, 113 and 114 are components, also include, as components, conductor members 167, 170, 176, 180 and 184; all of these members may be provided with external cooling channels (not shown) through which a cooling fluid may be circulated employing conventional inlet and outlet conduits. Mounting brackets 160–162 for transformer cores 156–158 also may have similar external cooling channels.

Referring again to FIG. 11, this figure also illustrates the flow path of the magnetic field resulting from the employment of an embodiment of magnetic dam 100 having a confining coil with a multi-piece front part 102 comprising conductor portions 112, 113 and 114. As noted before, the magnetic field is depicted by flow lines 98. (Section lines have been deleted in FIG. 11, for clarity purposes.)Magnetic member 106 and coil shield 108 have respective projections 58, 66 which extend beyond the front surfaces of conductor portions 112, 113, and overlap peripheral roll lip 52 thereby enhancing the flow of the magnetic field through peripheral roll lip 52 and molten metal pool 38. Projections 58 and 66 extend forwardly beyond the front surfaces of conductor portions 112, 113 a distance greater than one skin depth (δ) of the molten metal and less than three skin depths thereof, calculated on the basis of the resistivity (conductivity) of molten metal pool 38.

When molten metal pool 38 is composed of molten steel, wetting occurs at the interface between pool 38 and the adjacent surface of a casting roll 31 or 32. In order to effectively contain the molten metal pool at open end 36 of gap 35, at the aforementioned interface between pool 38 and adjacent casting roll 31 or 32, more magnetic pressure is required there than at a location horizontally further into the pool. In accordance with another embodiment of the present invention, a relatively increased magnetic confining pressure can be exerted at the interface between the pool and a casting roll 31 or 32 by increasing the time-varying current flowing through a wedge-shaped conductor portion (e.g. 113).

In all embodiments, the following conditions apply: the total current flowing through (a) wedge-shaped conductor portions 113, 114 and (b) first central conductor portion 112, is that particular current which is sufficient to contain the molten metal pool at all locations across its wide top part 38*a* (FIG. 1A); while the current flowing through first central conductor portion 112 is only that lesser current required to contain lower part 38*b* of molten metal pool 38 at nip 37 between casting rolls 31, 32.

Figure 17:
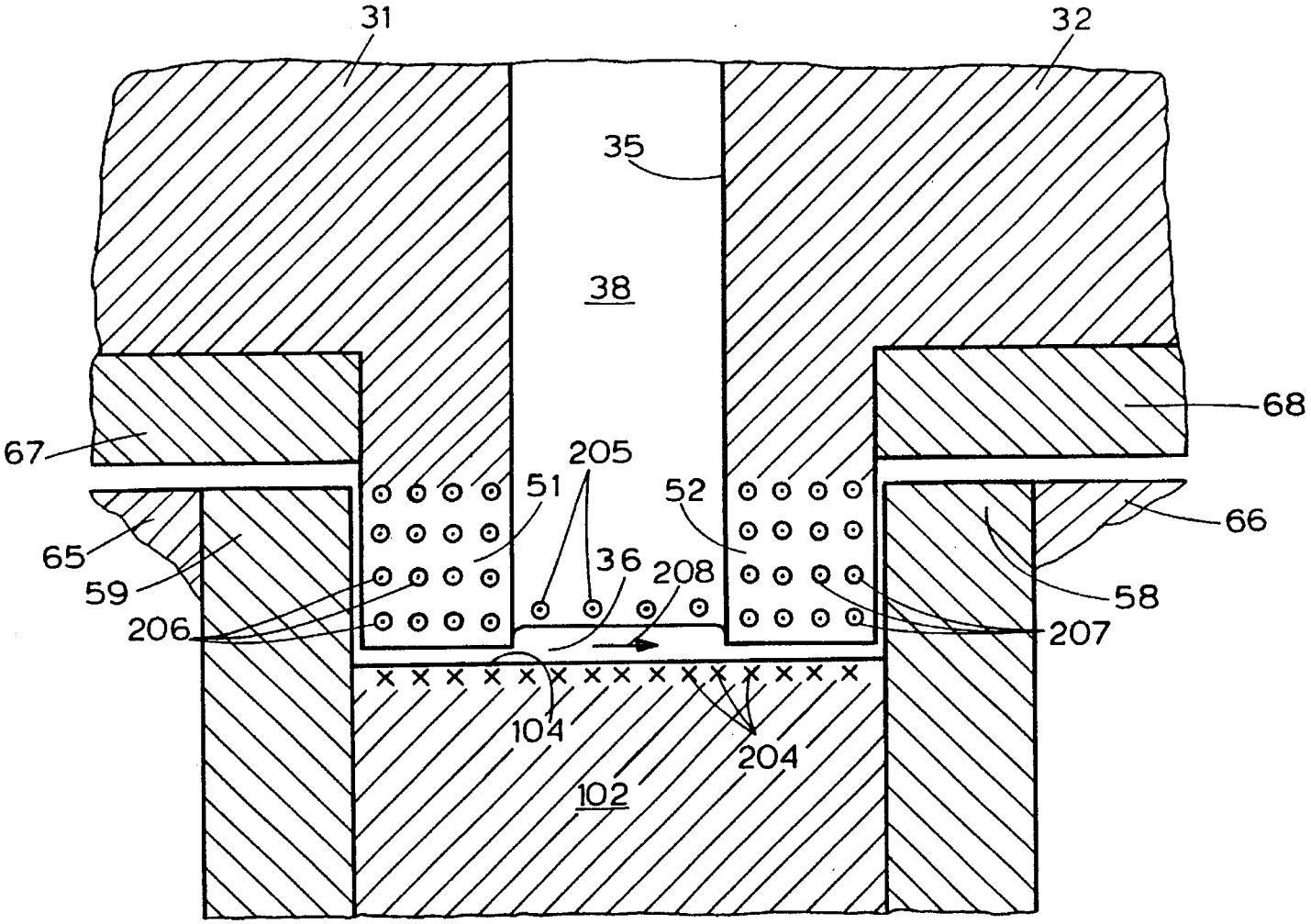
FIG. 17 is an enlarged, fragmentary sectional view similar to FIG. 4 and showing the direction (a) of conductive currents in the electromagnetic confining dam and (b) of induced eddy currents in other parts of the strip casting apparatus and in the molten metal pool.

Referring now to FIG. 17, the numeral 204 indicates the downward flow of electric current in the front surface 104 of the confining coil's first part 102. The numeral 205 indicates the resulting upward flow of current induced in molten metal pool 38. Numerals 206 and 207 indicate the resulting upward flow of current induced in peripheral roll lips 51, 52 respectively. Numeral 208 indicates the direction of flow of the horizontal magnetic field produced by time-varying conductive current 204 and enhanced by time-varying induced currents 205–207. The magnetic pressure due to the magnetic field at 208, generated by the time-varying conductive current 204, is increased by the magnetic field generated by the time-varying induced currents 205–207.

Referring again to FIG. 16, there is a mutual inductance between primary coils 153 and 154, between primary coils 153 and 155 and between primary coils 154 and 155. There is also leakage inductance for each of the primary coils 153–155 and its corresponding secondary coil.

These inductances, whether mutual inductance or leakage inductance, decrease the amount of current which can be delivered to the secondary coil of a transformer. However, (a) the total such inductance (mutual inductance plus leakage inductance) resulting from the employment of three transformers and three separate and discrete secondary current flows, in accordance with the present invention, is less than (b) the inductance described in the next sentence. Inductance (b) is that leakage inductance which would result if the same total current (e.g. the 20,000 A total from all three conductor portions 112, 113 and 114) had been flowed through a single conductor portion associated with a single transformer secondary coil and a single transformer primary coil. As a result, when employing circuitry in accordance with the present invention, there is less current lost for a given input voltage to the transformer(s), and electrical efficiency is improved.

Figure 18:
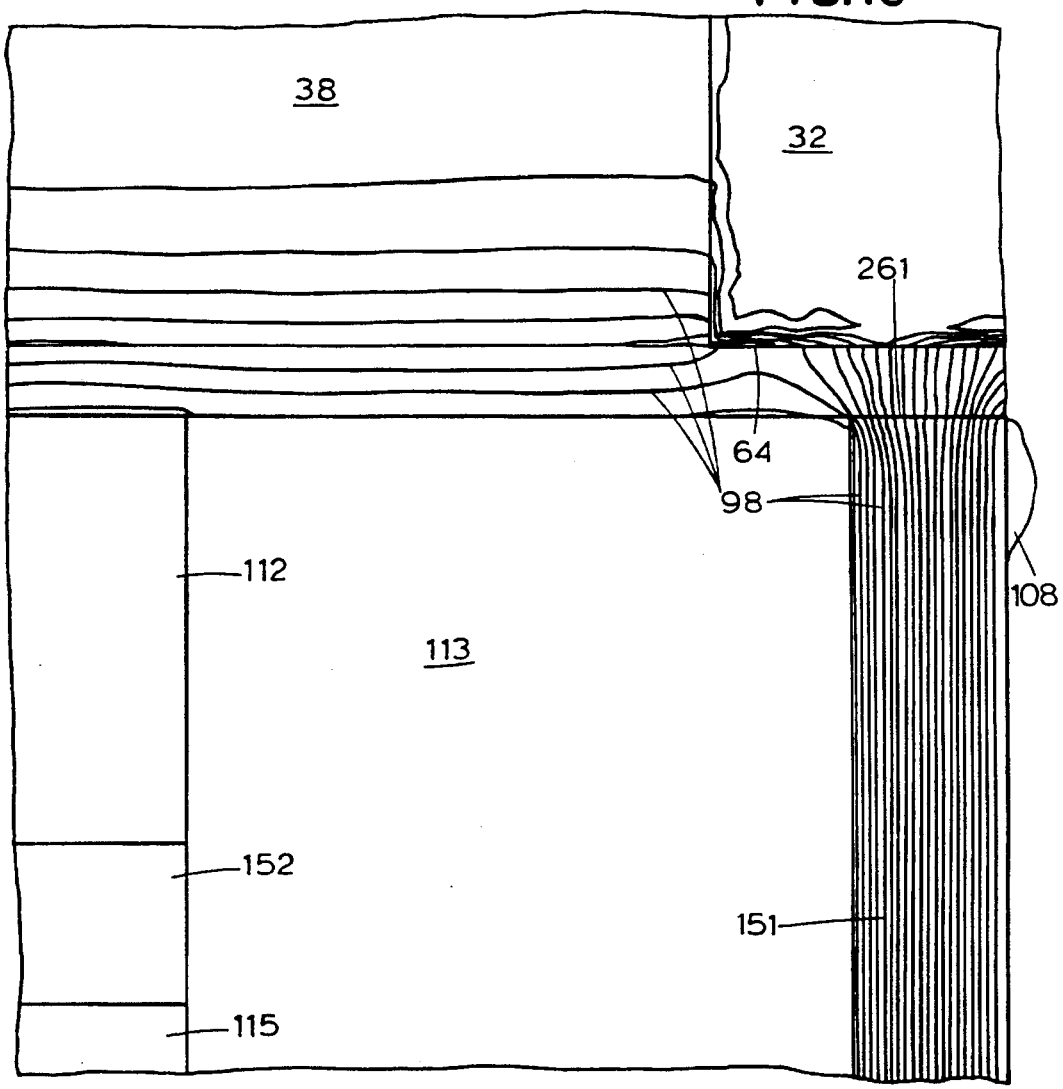
FIG. 18 is an enlarged, fragmentary view, similar to FIGS. 5 and 11, showing the magnetic field developed by a further embodiment of a strip casting apparatus with electromagnetic confining dam, in accordance with the present invention.

FIG. 18 illustrates an embodiment of the present invention in which roll 32 may be composed of a ferromagnetic material (described in detail below) and in which there are no projecting lips on roll 32 and no end projections on the side parts 151, 152 of magnetic member 106 or on coil shield 108 of dam 100. The magnetic field developed by the embodiment of FIG. 18 is illustrated by magnetic field lines 98 in FIG. 18 in which section lines have been deleted for clarity purposes.

As noted above, in the FIG. 18 embodiment, roll 32 may be composed of a ferromagnetic material. Examples of such materials include so-called "Super 12 Cr stainless steels". One such composition includes 12% chromium and 0.5% molybdenum; another includes 12% chromium, 1% molybdenum and 0.8% nickel; still another includes 10% chromium and 1% of each of molybdenum, copper and cobalt. With a roll composed of ferromagnetic material, one can obtain a good magnetic flux coupling between the dam and the pool of molten metal, without projections on the dam and without lips on the roll.

The ferromagnetic roll should be liquid cooled, employing expedients within the skill of the art. Preferably, one should cool the rolls used in all embodiments of the present invention.

Figure 21:
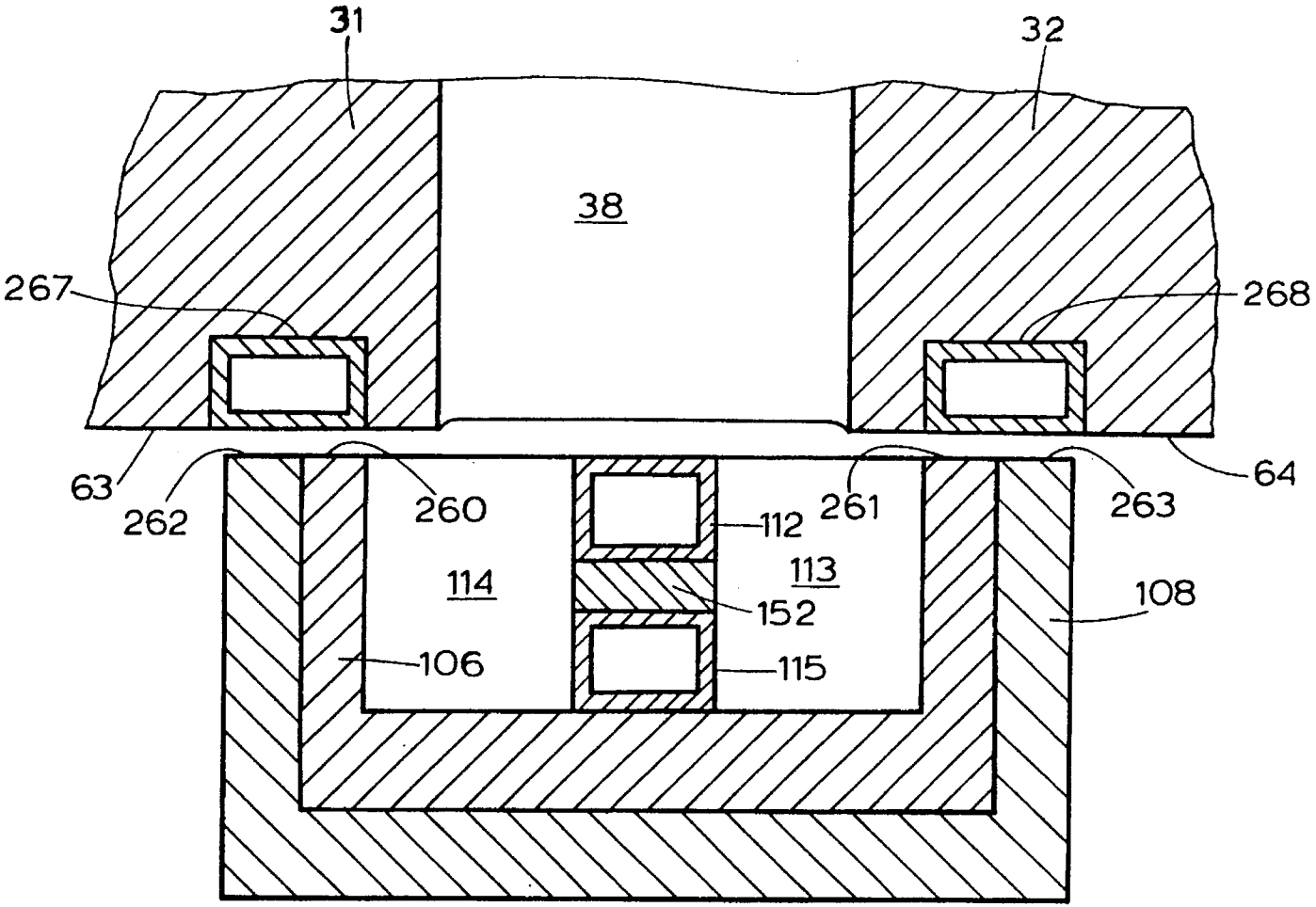
FIG. 21 is an enlarged, fragmentary sectional view of a variation of the embodiment of FIG. 18.

FIG. 21 illustrates a variation of the embodiment of FIG. 18, wherein each roll end 63, 64 of respective ferromagnetic rolls 31, 32 has a respective fluid cooled, tubular end shield 67, 268 directly opposite the facing ends 260, 261 of magnetic member 106 and 262, 263 of coil shield 108. Tubular end shields 67, 268 are composed of highly conductive, non-magnetic material, such as copper and are typically cooled with water.

The variation shown in FIG. 21 has certain advantages over the embodiment of FIG. 18 (in which the roll ends facing magnetic member 106 and coil shield 108 are composed entirely of the same ferromagnetic material as the rest of rolls 31, 32). In the variation of FIG. 21, there is: (a) less total power loss to rolls 31, 32, (b) less total heating of the rolls, and (c) some increase in the magnetic field developed to contain pool 38. The electric currents induced in copper end shields 267, 268 cause the magnetic field, flowing between the end shields and ends 260, 261 of magnetic member 106, to be bent from (i) a direction normal to the adjacent surface of roll end 63 or 64 (FIG. 18) to (ii) a direction parallel to the adjacent roll end surface, thereby minimizing the penetration of the magnetic field into the roll end at a location opposite an end 260, 261 of magnetic member 106.

There may be a small clearance (not shown) between (i) tubular end shield 267 or 268 and (ii) adjacent parts of a corresponding roll 31, 32 to accommodate the difference in thermal expansion between the copper of end shields 267, 268 and the ferromagnetic material of rolls 31, 32.

The physical configuration of dam 100 shown in FIG. 18 (i.e. without end projections on magnetic member 106 and coil shield 108) is not limited to a dam 100 used with a roll composed of ferromagnetic material. A roll composed of copper or stainless steel could also be used with the dam shown in FIG. 18; magnetic coupling may be reduced, however.

Conversely, a roll 32 composed of ferromagnetic material may be constructed with projecting lips, as in FIGS. 4–5, 7, 11 and 7, for example, and, when so constructed, may be used with dams having end projections on the dam's magnetic member and coil shield. Mechanical clearance problems can occur, however, when such a roll has lips and the dam has projections, and there is thermal expansion of the roll (and of the dam) during operation. Appropriate cooling and spacing expedients would be needed to accommodate that expansion, and examples thereof have been described above.

As noted above, a purpose of the coil shield in all embodiments is to confine that part of the magnetic field, which is outside of the low reluctance return path defined by the magnetic member, to substantially a space adjacent the open end of the gap between the casting rolls. The existence of some magnetic field leakage away from that space (e.g. as illustrated in FIGS. 11 and 18) is not a substantial departure from fulfilling that purpose, in accordance with the present invention. Reference herein to a coil shield which performs that purpose encompasses coil shields with which such leakage occurs.

The foregoing detailed description has been given for clearness of understanding only, and no unnecessary limitations should be understood therefrom, as modifications will be obvious to those skilled in the art.

We claim:

1. A strip casting apparatus comprising:

a pair of horizontally disposed, counter-rotating rolls having a vertically extending gap therebetween for containing a pool of molten metal, said gap having an open end;

an electromagnetic dam for preventing the escape of molten metal through the open end of said gap;

said dam comprising a vertically disposed confining coil having a front surface facing said open end of the gap, adjacent thereto, and other coil surfaces;

means for flowing a time-varying electric current through said confining coil to generate a horizontal magnetic field which extends from the front surface of said confining coil through the open end of said gap and exerts a magnetic confining pressure on said pool of molten metal at the open end of said gap;

magnetic means enveloping a substantial part of said confining coil other than said front surface thereof and comprising means (a) for substantially preventing said time-varying electric current from flowing along surfaces of said confining coil other than said front surface thereof, and (b) for providing a low reluctance return path for said magnetic field;

a coil shield composed of non-magnetic, electrically conductive material, substantially enveloping said magnetic enveloping means and comprising means for confining that part of said magnetic field which is outside of said low reluctance return path to substantially a space adjacent the open end of said gap;

means for electrically insulating said magnetic enveloping means from said confining coil;

a peripheral roll lip at the end of each casting roll;

said peripheral roll lip having a terminal end surface facing said front surface of the confining coil, adjacent thereto;

said peripheral roll lip comprising means defining a part of the path followed by said magnetic field;

and means located alongside said peripheral roll lip, in a radially inward direction therefrom, for defining another part of the path followed by said magnetic field;

said peripheral roll lip and said means located alongside the peripheral roll lip each being composed of a material having an electrical conductivity less than that of copper;

said apparatus being devoid of any magnetic field shield, between said front surface of said confining coil and the open end of said gap, and which is separate and discrete from said front surface;

said means located alongside the peripheral roll lip comprising an element separate and discrete from said magnetic enveloping means, spaced therefrom and having a front part;

said front part of said separate and discrete element facing said magnetic enveloping means and being substantially coterminous with the terminal end surface of said peripheral roll lip;

said magnetic enveloping means having a terminal end surface which faces the front part of said element and is substantially coterminous with said front surface of the confining coil.

2. An apparatus as recited in claim 1 wherein:

said terminal end surface of said peripheral roll lip protrudes outwardly from said casting roll, in an axial direction, beyond the end of said roll.

3. An apparatus as recited in claim 1 wherein:

said separate and discrete element comprises a front part facing said dam;

and said terminal end surface of said peripheral roll lip is substantially coterminous with the front part of said element.

4. An apparatus as recited in claim 1 or 2 wherein said separate and discrete element is separate and discrete from each casting roll and comprises:

a first side surface facing said peripheral roll lip;

a second side surface spaced radially inwardly from said first side surface;

and a rear surface adjacent an end of a respective casting roll.

5. An apparatus as recited in claim 4 wherein:

said second side surface of said element extends angularly in a radially inward direction from said front part to said rear surface of said element; and the distance between said side surfaces, across said element, increases from said front part to said rear surface of said element.

6. An apparatus as recited in claim 4 and comprising:

a space located between said first side surface of said element and said peripheral roll lip and comprising means for receiving a cooling fluid for cooling said peripheral roll lip.

7. An apparatus as recited in claim 1 wherein:

said coil shield has a terminal end surface which faces an end of a respective casting roll and is substantially coterminous with said terminal end surface of the magnetic enveloping means.

8. An apparatus as recited in claim 2 or 3 wherein:

said peripheral roll lip is composed of non-magnetic material;

and said separate and discrete element is composed of magnetic material.

9. An apparatus as recited in claim 1 or 2 wherein:

said separate and discrete element and said peripheral roll lip are both composed of non-magnetic material.

10. An apparatus as recited in claim 1 or 2 and comprising:

a roll end shield at the end of each casting roll and located radially inwardly of said peripheral roll lip;

said roll end shield having a higher electrical conductivity than said peripheral roll lip and said element;

said roll end shield comprising means for substantially preventing said magnetic field from following a flow path other than across said gap adjacent said open end thereof.

11. An apparatus as recited in claim 10 wherein:

said roll end shield is located radially inwardly of said separate and discrete element.

12. An apparatus as recited in claim 1 and comprising:

means for cooling said peripheral roll lip along an arcuate segment through which said lip rotates immediately after it has rotated through the magnetic field generated by said confining coil;

the arcuate segment in which the rotating lip undergoes cooling being substantially greater than the arcuate segment in which the lip is subjected to said magnetic field.

13. An apparatus as recited in claim 12 wherein:

said peripheral roll lip has a curvature corresponding to the curvature of said roll and has an inner surface located radially inwardly of the roll's outer periphery;

and said cooling means comprises means for directing a cooling fluid against said inner surface of the peripheral roll lip along an arcuate segment of said surface.

14. A strip casting apparatus comprising:

a pair of horizontally disposed, counter-rotating rolls having a vertically extending gap therebetween for containing a pool of molten metal, said gap having an open end;

an electromagnetic dam for preventing the escape of molten metal through the open end of said gap;

said dam comprising a vertically disposed confining coil having a front surface facing said open end of the gap, adjacent thereto, and other coil surfaces;

means for flowing a time-varying electric current through said confining coil to generate a horizontal magnetic field which extends from the front surface of said confining coil through the open end of said gap and exerts a magnetic confining pressure on said pool of molten metal at the open end of said gap;

magnetic means enveloping a substantial part of said confining coil other than said front surface thereof and comprising means (a) for substantially preventing said time-varying electric current from flowing along surfaces of said confining coil other than said front surface thereof, and (b) for providing a low reluctance return path for said magnetic field;

a coil shield composed of non-magnetic, electrically conductive material, substantially enveloping said magnetic enveloping means and comprising means for confining that part of said magnetic field which is outside of said low reluctance return path to substantially a space adjacent the open end of said gap;

means for electrically insulating said magnetic enveloping means from said confining coil;

a peripheral roll lip at the end of each casting roll;

said peripheral roll lip having a terminal end surface facing said front surface of the confining coil, adjacent thereto;

said peripheral roll lip comprising means defining a part of the path followed by said magnetic field;

means located alongside said peripheral roll lip, in a radially inward direction therefrom, for defining another part of the path followed by said magnetic field;

said peripheral roll lip and said means located alongside the peripheral roll lip each being composed of a material having an electrical conductivity less than that of copper;

said apparatus being devoid of any magnetic field shield, between said front surface of said confining coil and the open end of said gap, and which is separate and discrete from said front surface;

a roll end shield at the end of each casting roll, located radially inwardly of said peripheral roll lip and covering the end of the casting roll;

and a shield extension protruding from said roll end shield, outwardly in an axial direction;

said roll end shield and said extension thereof being composed of non-magnetic, electrically conductive material having a higher electrical conductivity than said peripheral roll lip and said means located alongside said peripheral roll lip;

said terminal end surface of said peripheral roll lip protruding outwardly from said casting roll, in an axial direction, beyond the end of said roll;

said roll end shield and said extension thereof comprising means for substantially preventing said magnetic field from following a flow path other than across said gap adjacent said open end thereof;

said peripheral roll lip and said roll end shield extension defining an annular space therebetween;

said magnetic enveloping means and said confining coil shield each comprise a projection protruding beyond said front surface of said confining coil and into said annular space;

said projection on said magnetic enveloping means incorporates said means located alongside the peripheral roll lip.

15. An apparatus as recited in 14 wherein:

said projection of said magnetic enveloping means and said projection of said confining coil shield each protrude beyond said front surface of said confining coil a distance between one and three skin depths (6) of the molten metal in said gap;

said skin depth being expressed as $$\delta = \sqrt{2/\omega\mu\sigma}$$

where $\delta$ is the skin depth of the molten metal $\omega$ is $2\pi f$ f is the frequency of the time-varying current to be employed $\mu$ is the magnetic permeability of air $\sigma$ is the electrical conductivity of the molten metal.

16. An apparatus as recited in claim 14 wherein:

said extension of the roll end shield protrudes further outwardly in an axial direction than said peripheral roll lip.

17. An apparatus as recited in claim 14 wherein:

all of said shields are composed of copper; and said peripheral roll lip is composed of non-magnetic stainless steel.

18. An apparatus as recited in claim 14 wherein:

said peripheral roll lip has a thickness (dimension in a radial direction) less than two skin depths ($\delta$) of said peripheral roll lip;

said skin depth being expressed as $$\delta = \sqrt{2/\omega\mu\sigma}$$

where $\delta$ is the skin depth of the material of which said peripheral roll lip is composed $\omega$ is $2\pi f$ f is the frequency of the time-varying magnetic current to be employed $\mu$ is the magnetic permeability of said material $\sigma$ is the electrical conductivity of said material.

19. A strip casting apparatus comprising:

a pair of horizontally disposed, counter-rotating rolls having a vertically extending gap therebetween for containing a pool of molten metal, said gap having an open end;

an electromagnetic dam for preventing the escape of molten metal through the open end of said gap;

said dam comprising a vertically disposed confining coil having a front surface facing said open end of the gap, adjacent thereto, and other coil surfaces;

means for flowing a time-varying electric current through said confining coil to generate a horizontal magnetic field which extends from the front surface of said confining coil through the open end of said gap and exerts a magnetic confining pressure on said pool of molten metal at the open end of said gap;

magnetic means enveloping a substantial part of said confining coil other than said front surface thereof and comprising means (a) for substantially preventing said time-varying electric current from flowing along surfaces of said confining coil other than said front surface thereof, and (b) for providing a low reluctance return path for said magnetic field;

a coil shield composed of non-magnetic, electrically conductive material, substantially enveloping said magnetic enveloping means and comprising means for confining that part of said magnetic field which is outside of said low reluctance return path to substantially a space adjacent the open end of said gap;

means for electrically insulating said magnetic enveloping means from said confining coil;

a peripheral roll lip at the end of each casting roll;

said peripheral roll lip having a terminal end surface facing said front surface of the confining coil, adjacent thereto;

said peripheral roll lip comprising means defining a part of the path followed by said magnetic field;

means located alongside said peripheral roll lip, in a radially inward direction therefrom, for defining another part of the path followed by said magnetic field;

said peripheral roll lip and said means located alongside the peripheral roll lip each being composed of a material having an electrical conductivity less than that of copper;

said apparatus being devoid of any magnetic field shield, between said front surface of said confining coil and the open end of said gap, and which is separate and discrete from said front surface;

a roll end shield at the end of each casting roll, located radially inwardly of said peripheral roll lip and covering the end of the casting roll;

and a shield extension protruding from said roll end shield, outwardly in an axial direction;

said roll end shield and said extension thereof being composed of non-magnetic, electrically conductive material having a higher electrical conductivity than said peripheral roll lip and said means located alongside said peripheral roll lip;

said terminal end surface of said peripheral roll lip protruding outwardly from said casting roll, in an axial direction, beyond the end of said roll;

said roll end shield and said extension thereof comprising means for substantially preventing said magnetic field from following a flow path other than across said gap adjacent said open end thereof;

said peripheral roll lip and said roll end shield extension defining an annular space therebetween;

said means located alongside the peripheral roll lip comprising an annular mender located in said annular space at the roll end;

said magnetic enveloping means comprising a front surface spaced from and facing said annular member, said front surface of the magnetic enveloping means being disposed along a segment of the arcuate path followed by said annular member as its casting roll rotates.

20. An apparatus as recited in claim 19 wherein:

said annular space is substantially completely filled by said annular member.

21. An apparatus as recited in claim 19 and comprising:

a gap in said annular space, between said peripheral roll lip and said annular member;

said gap comprises means for receiving a jet of cooling gas for cooling said peripheral roll lip.

22. An apparatus as recited in claim 19 wherein:

said annular member is composed of either magnetic material or non-magnetic material having an electrical conductivity less than that of copper.

23. A strip casting apparatus-comprising:

a pair of horizontally disposed, counter-rotating rolls having a vertically extending gap therebetween for containing a pool of molten metal, said gap having an open end;

an electromagnetic dam for preventing the escape of molten metal through the open end of said gap;

said dam comprising a vertically disposed confining coil having a front surface facing said open end of the gap, adjacent thereto, and other coil surfaces;

means for flowing a time-varying electric current through said confining coil to generate a horizontal magnetic field which extends from the front surface of said confining coil through the open end of said gap and exerts a magnetic confining pressure on said pool of molten metal at the open end of said gap;

magnetic means enveloping a substantial part of said confining coil other than said front surface thereof and comprising means (a) for substantially preventing said time-varying electric current from flowing along surfaces of said confining coil other than said front surface thereof, and (b) for providing a low reluctance return path for said magnetic field;

a coil shield composed of non-magnetic, electrically conductive material, substantially enveloping said magnetic enveloping means and comprising means for confining that part of said magnetic field which is outside of said low reluctance return path to substantially a space adjacent the open end of said gap;

means for electrically insulating said magnetic enveloping means from said confining coil;

a peripheral roll lip at the end of each casting roll;

said peripheral roll lip having a terminal end surface facing said front surface of the confining coil, adjacent thereto;

said peripheral roll lip comprising means defining a part of the path followed by said magnetic field;

and means located alongside said peripheral roll lip, in a radially inward direction therefrom, for defining another part of the path followed by said magnetic field;

said peripheral roll lip and said means located alongside the peripheral roll lip each being composed of a material having an electrical conductivity less than that of copper;

said apparatus being devoid of any magnetic field shield, between said front surface of said confining coil and the open end of said gap, and which is separate and discrete from said front surface;

each peripheral roll lip protruding outwardly from a respective casting roll, in an axial direction, toward said front surface of the confining coil;

said magnetic enveloping means comprising a pair of spaced-apart projections each located on a respective opposite side of said front surface of the confining coil and each protruding outwardly beyond said front surface toward an end of a respective casting roll;

each of said projections having a terminal end adjacent an end of a respective casting roll and facing said casting roll end;

said means disposed alongside each peripheral roll lip comprising one of said projections of the magnetic enveloping means;

said peripheral roll lips being disposed between said spaced-apart projections of the magnetic enveloping means;

each of said peripheral roll lips being disposed alongside one of said projections, adjacent thereto;

there being no intervening structure between a peripheral roll lip and the adjacent projection.

24. An apparatus as recited in claim 23 wherein:

said coil shield comprises a pair of spaced-apart projections each located alongside a respective projection of said magnetic enveloping means and substantially coextensive therewith.

25. An apparatus as recited in claim 23 or 24 and comprising:

a roll end shield at the end of each casting roll, said roll end shield being located radially inwardly of said peripheral roll lip on that roll and covering said roll end;

said roll end shield having a higher electrical conductivity than said peripheral roll lip;

said roll end shield comprising means for substantially preventing magnetic flux from exiting the adjacent terminal end of a projection and for compelling said magnetic field to follow substantially a flow path which extends between said pair of projections, across said pair of peripheral lips and across said gap adjacent said open end thereof.

26. An apparatus as recited in claim 25 wherein:

said peripheral roll lip and the peripheral surface of said casting roll are composed of the same non-magnetic, electrically conductive material.

27. An apparatus as recited in claim 25 wherein:

said peripheral roll lip protrudes beyond the end of said roll end shield a distance greater than 80% of the skin depth ($\delta$) of said molten metal in said pool.

28. An apparatus as recited in claim 26 or 27 wherein:

said peripheral roll lip has a thickness (dimension in a radial direction) less than two skin depths ($\delta$) of said peripheral roll lip.

29. An apparatus as recited in claim 28 wherein:

said thickness is less than one skin depth.

* * * * *

UNITED STATES PATENT AND TRADEMARK OFFICE

CERTIFICATE OF CORRECTION

PATENT NO. : 5,562,152

DATED : October 8, 1996

INVENTOR(S) : Howard L. Gerber and Ismael G. Saucedo

It is certified that error appears in the above-identified patent and that said Letters Patent is hereby corrected as shown below:

Col. 8, line 40, "(Pro)" should be -- $(P_m)$--.

Col. 11, line 26, "materials" should be --material--.

Col. 24, line 61, "7" should be --17--.

Signed and Sealed this

Eighteenth Day of February, 1997

*Attest:*

*Attesting Officer*

BRUCE LEHMAN

*Commissioner of Patents and Trademarks*